US006463651B1

(12) United States Patent
Koeneker et al.

(10) Patent No.: US 6,463,651 B1
(45) Date of Patent: Oct. 15, 2002

(54) METHOD OF MANUFACTURING BED FRAME

(76) Inventors: William V. Koeneker, 12852 Vista Ridge, St. Louis, MO (US) 63138; Ethan J. Schuman, 658 N. New Ballas, Creve Coeur, MO (US) 63141

( * ) Notice: Subject to any disclaimer, the term of this patent is extended or adjusted under 35 U.S.C. 154(b) by 0 days.

(21) Appl. No.: 09/317,004

(22) Filed: May 24, 1999

Related U.S. Application Data

(63) Continuation-in-part of application No. 09/036,072, filed on Mar. 6, 1998, now abandoned.

(51) Int. Cl.[7] ..... B21D 39/00

(52) U.S. Cl. ..... 29/513; 29/521; 5/194; 5/200.1; 5/206; 72/379.2

(58) Field of Search ..... 29/513, 521; 5/200.1, 5/201, 203, 206, 205, 207, 210, 188, 189, 191, 186.1, 194; 72/379.2, 186, 177, 181

(56) References Cited

U.S. PATENT DOCUMENTS

| | | | | |
|---|---|---|---|---|
| 971,688 A | | 10/1910 | Row | |
| 1,670,055 A | | 5/1928 | Trimble | |
| 1,676,222 A | | 7/1928 | Sheldon | |
| 1,800,793 A | | 4/1931 | Harms | |
| 2,040,995 A | | 5/1936 | Holt | |
| 2,924,832 A | | 2/1960 | Knowles | |
| 3,300,829 A | | 1/1967 | Hegman et al. | |
| 3,636,574 A | | 1/1972 | Kramer | 5/186 |
| 3,784,992 A | | 1/1974 | Galiani | 5/186 R |
| 3,805,367 A | | 4/1974 | Hasty | 29/448 |
| 4,016,612 A | * | 4/1977 | Barile, Sr. | 5/200 |
| 4,044,436 A | | 8/1977 | Patrick | 27/12 |
| 4,468,946 A | * | 9/1984 | Driear | 72/379 |
| 4,881,306 A | | 11/1989 | Ernat et al. | 27/12 |
| 5,501,053 A | * | 3/1996 | Goleby | 52/729.5 |
| 5,718,142 A | * | 2/1998 | Ferraro | 72/326 |

FOREIGN PATENT DOCUMENTS

GB 2077579 * 12/1981

* cited by examiner

*Primary Examiner*—S. Thomas Hughes
*Assistant Examiner*—John C. Hong
(74) *Attorney, Agent, or Firm*—Suelthaus & Walsh, P.C.

(57) ABSTRACT

A bed, more particularly a coffin bed, comprising a rectangular frame formed by a single member formed of sheet metal strip having a tubular section functioning as a beam and a flange extending from the tubular section, and a body support which may be constituted by a piece of plastic netting, attached to the flange, the frame per se, and a method of manufacture thereof involving cold rolling of the strip.

18 Claims, 22 Drawing Sheets

METHOD OF MANUFACTURING BED FRAME

CROSS-REFERENCE TO RELATED APPLICATION

This application is a continuation-in-part of our U.S. application Ser. No. 09/036,072 filed Mar. 6, 1998, now abandoned entitled Bed, Frame Thereof and Method of Manufacture.

BACKGROUND OF THE INVENTION

This invention relates to a bed, the frame thereof, and a method of manufacture thereof, and more particularly to a bed which may be referred to as a casket bed or a coffin bed, the frame thereof, and a method of manufacturing the frame and the assembly with the frame of a body support.

The invention is directed particularly to beds such as used in coffins, reference being made to the following United States patents involving prior art showing such beds:

| U.S. Pat. No. | Issue Date |
|---|---|
| 1,800,793 | April 14, 1931 |
| 3,300,829 | January 31, 1967 |
| 4,044,436 | August 30, 1977 |
| 4,881,306 | November 21, 1989 |

BRIEF SUMMARY OF THE INVENTION

Among the several objects of the invention may be noted the provision of a bed and frame thereof, and more particularly a coffin bed and frame thereof, of economical construction both as to materials and assembly; the provision of an economical method of manufacturing the frame and the assembly with the frame of a body support; the provision of a bed comprising the frame and the body support with the frame economically formed from sheet metal strip; and the provision of such a bed wherein the body support economically comprises plastic netting.

In general a bed frame of this invention is of rectangular form having elongate sides and relatively narrow ends. Each of the sides and ends comprises a rail or bar formed of sheet metal strip. Each bar is of such overall cross-section as to comprise a tubular section adapted to function as a beam with strength in bending resistant to forces transverse thereto and further to comprise a flange extending from said tubular section adapted for attachment thereto of a body support.

In another aspect of the invention, the bed frame is formed by a single member formed of sheet metal strip bent into the shape of a rectangle thereby forming the bars at the sides of the frame and the bars at the ends of the frame, the ends of said member meeting one with the other, and said frame having means joining said meeting ends.

A bed of this invention generally comprises a bed frame as set forth above and a body support attached thereto. The body support may comprise a rectangular piece of plastic netting.

In general, the method of this invention for manufacturing a bed frame of rectangular shape for accepting a body support comprises cold rolling a strip of sheet metal to form it into bar stock of such overall cross-section as to comprise a tubular section adapted to function as a beam with strength in bending resistant to forces transverse thereto and further to comprise a flange extending from the beam comprising a portion of the sheet metal strip. The bar stock is notched at intervals such as to define side bars and end bars of the rectangular frame. The stock is segmented into lengths thereof with each length corresponding to the total length of the periphery of the frame and including a number of said notches defining corners of the frame to be formed, the length being bent at notches thereof to form it into said frame bringing together the ends of said length, the notches where said length is bent forming mitered corners of the frame, and the ends are fastened together.

The method of this invention for manufacturing a bed comprises manufacturing a frame as set forth above and applying a bed support to the frame as will appear.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
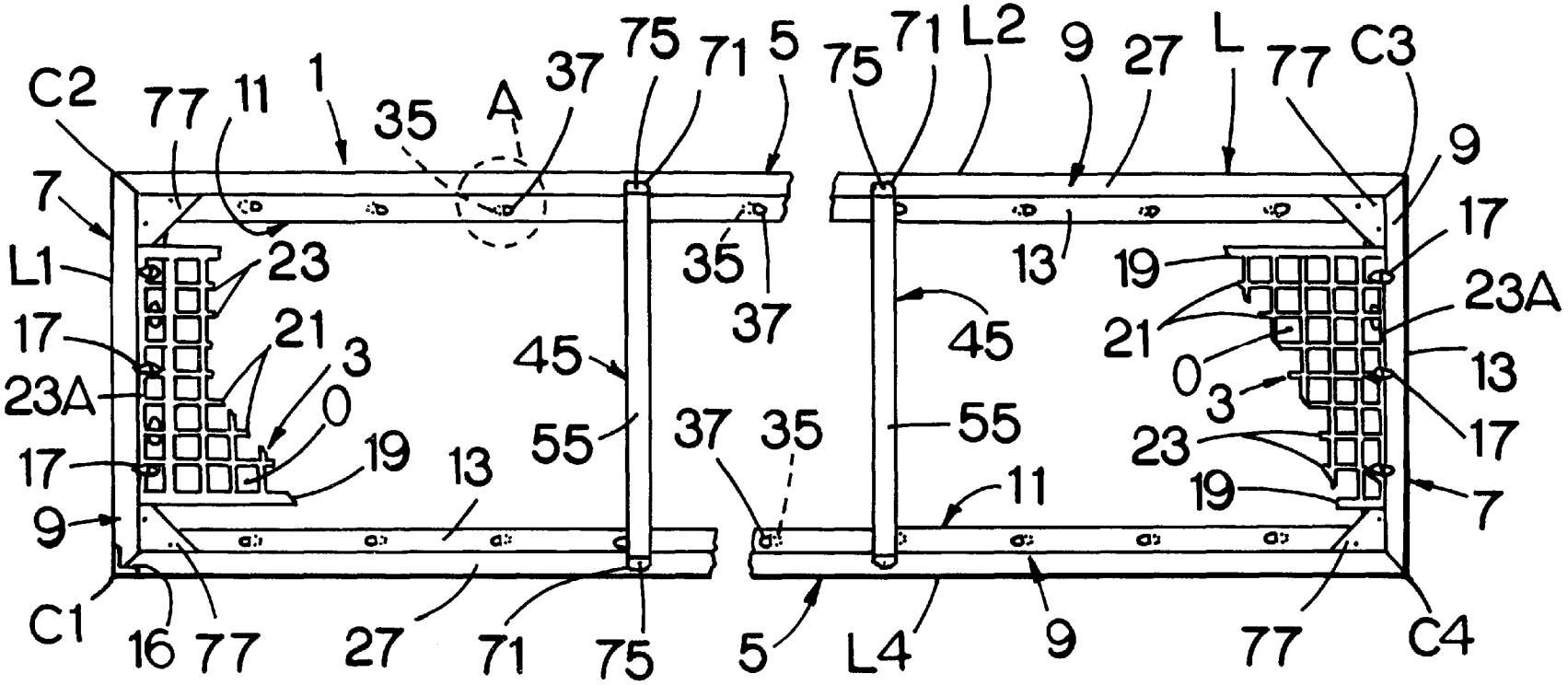
FIG. 1 is a plan of a bed of this invention with the frame of the bed broken away in part to reduce the length of the view and showing the body support of the bed assembled with the frame, the body support comprising plastic netting and shown broken away.
Figure 3:
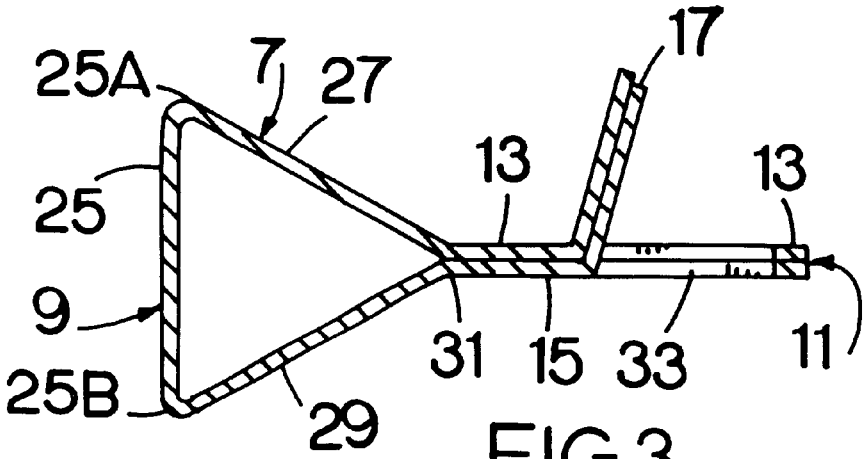
FIG. 3 is an enlarged vertical transverse section generally on line 3—3 of FIG. 2, showing the cross-section of an end bar of the frame where it is formed with a tab for connection of the plastic netting constituting the body support.
Figure 3A:
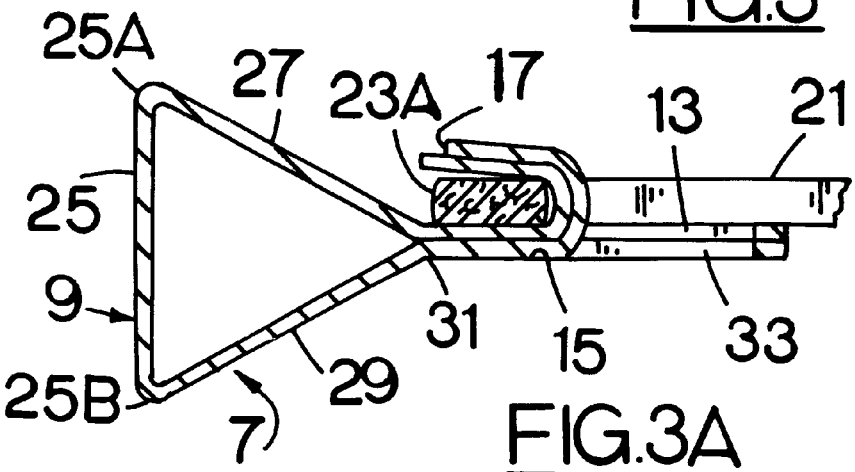
FIG. 3A is a view similar to FIG. 3 showing the tab bent over on the netting.
Figure 4:
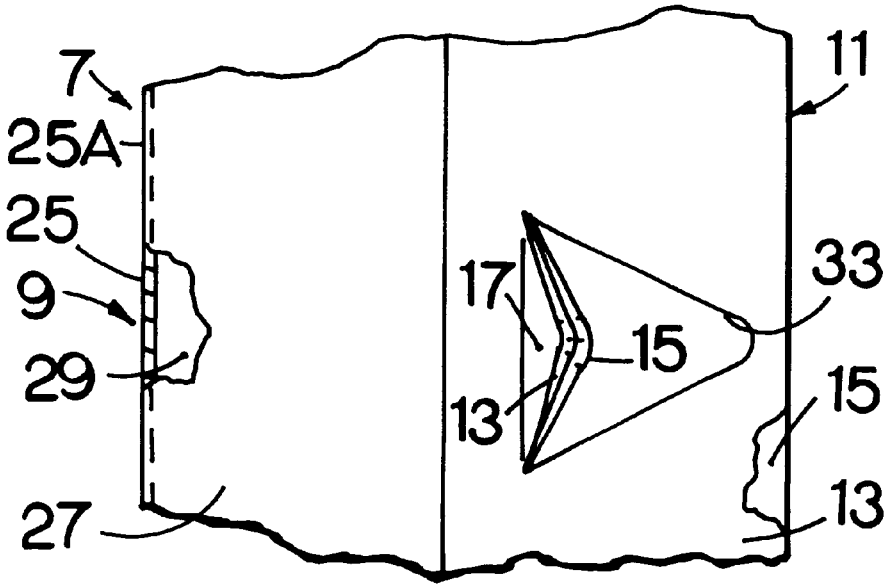
FIG. 4 is an enlarged fragment of FIG. 2 with parts broken away and shown in section showing a tab such as shown in FIG. 3.
Figure 5:
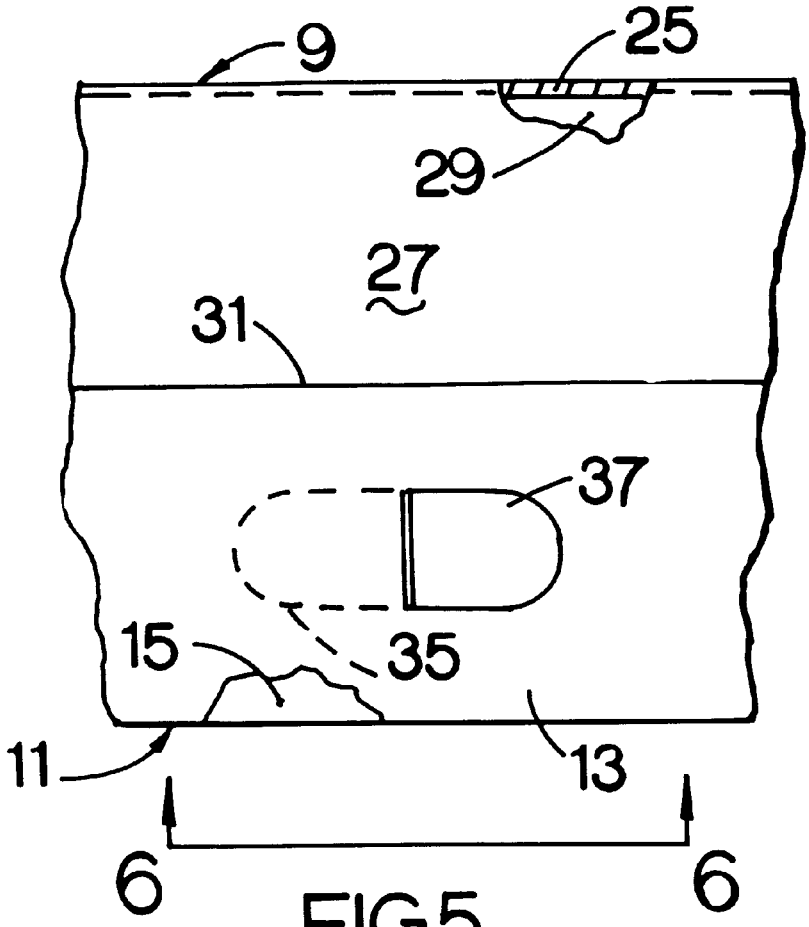
FIG. 5 is an enlarged fragment of the part of FIG. 1 indicated at A in FIG. 1 with parts broken away and shown in section.

Referring to the drawings, a first version of the bed of this invention is shown in FIG. 1 as comprising a frame of rectangular shape designated in its entirety by the reference numeral 1 and a body support designated in its entirety by the reference numeral 3 supported by the frame within the frame. The frame has sides each designated 5 and ends each designated 7, each of the sides and each of the ends comprising a rail or bar formed of sheet metal strip (e.g. 24 gauge cold rolled steel) having an outside section indicated generally at 9 shaped to function as a beam having strength in bending resistant to forces transverse thereto, more particularly having strength in bending in a generally horizontal plane and also in a generally vertical plane, and an inside section indicated generally at 11 in the form of a flange extending inwardly from the outside section. As shown in FIG. 3 the flange 11 is of double-layer construction comprising a first marginal portion 13 of the sheet metal strip S (see FIG. 11) from which the bars are formed superimposed generally flatwise on a second marginal portion 15 of the sheet metal strip. The flange 11 of each end bar 7 has integral portions thereof struck up therefrom at spaced intervals along its length forming tabs 17 for attachment to the frame of the body support 3. Each end bar 7 is shown as having three such tabs spaced at intervals along the length of the bar at the quarter points of the bar, by way of example only.

Figure 12:
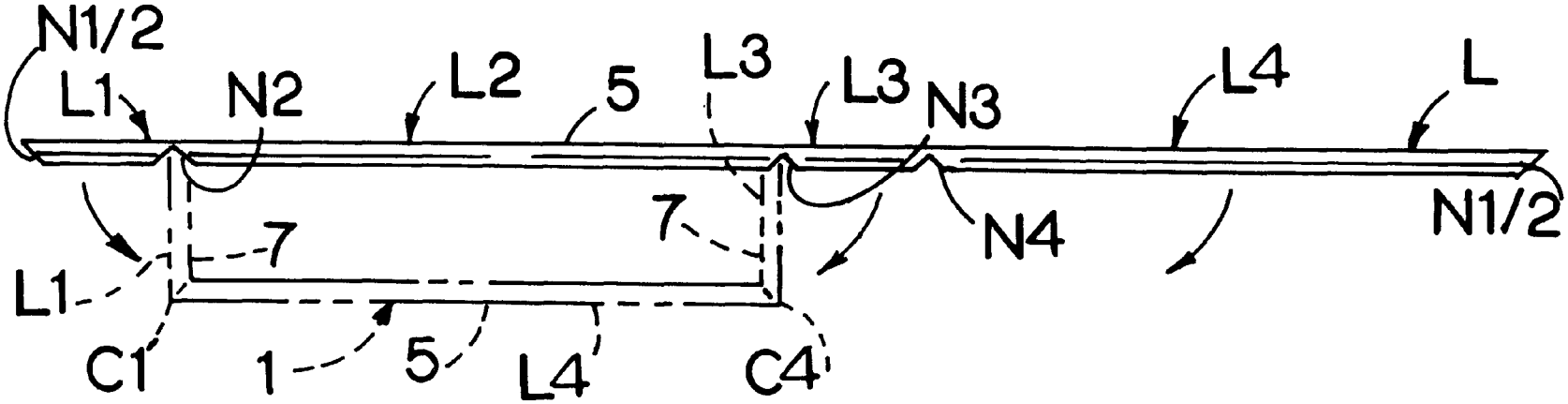
FIG. 12 is a view of a one-frame length of the bar stock segmented from the stock shown in FIG.11, illustrating in phantom how the length is bent to form a frame.

The frame 1 is formed by a single member (which may be referred to as a frame length) such as that shown in FIG. 12 indicated in its entirety by the letter L, this member being bent into the shape of a rectangle thereby forming the bars 5 at the sides of the frame and the bars 7 at the ends of the frame. The four corners of the frame are designated C1, C2, C3 and C4. The ends of said member or frame length L meet at corner C1, where they are joined by means generally indicated at 16 in FIGS. 1, 2 and 7. The member or frame length L is produced by the method of this invention to be subsequently described, with notches where it is to be bent for forming the corners as mitered corners.

The body support 3 comprises a rectangular piece of plastic netting e.g. netting made of high density polyethylene, preferably of generally square mesh conformation with relatively wide side strands 19, relatively narrow longitudinal strands 21 extending parallel to one another between the side strands, and relatively narrow transverse strands 23 with the strands so spaced that the netting has generally square openings such as indicated at O. Typically, for a frame 1 which is six feet long and eighteen inches wide, the piece of netting, in relaxed (unstretched) condition, is five feet ten and three/thirty seconds inches long (almost two inches less than the length of the frame), and one foot wide. The side strands are generally ½ inch wide, the longitudinal strands are generally ⅛ inch wide and the transverse strands are generally ⅛ wide. The openings O in the netting are generally 1 ⅜ inches square. It will be understood that the netting may be of different conformations other than that shown.

It is contemplated that the body support may be something other than plastic netting, e.g., wire mesh, and the frame modified in appropriate manner for attachment thereto of the body support, all as will be subsequently described.

Figure 6:
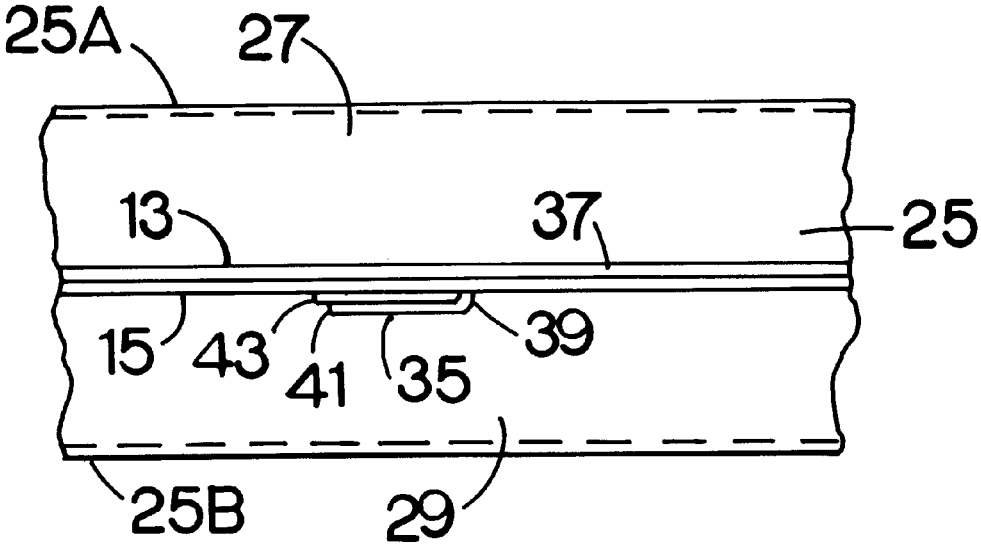
FIG. 6 is a view on line 6—6 of FIG. 5.

The outside section 9 of each of the side bars 5 and each of the end bars 7 is of tubular shape in transverse section (as shown in FIG. 3 for end bar 7), and more particularly in the shape of a hollow triangle in transverse section having an outside generally vertical leg 25 and upper and lower legs 27 and 29 converging from the upper and lower edges 25*a*, 25*b* of the vertical leg toward one another and meeting at a point constituting the apex 31 of the triangle. The aforementioned first marginal portion 13 of the sheet metal strip S from which the bars 5, 7 are formed extends generally horizontally inward from the inner edge of the upper leg at said apex 31 and the aforementioned second marginal portion 15 of the strip extends generally horizontally inward from the inner edge of the lower leg 29 at said apex, these margins being engaged flatwise one with the other. The tabs 17 are formed by striking up triangular portions of the flange 11 (both layers 13 and 15), leaving triangular openings 33 in the flange. The stated first and second marginal portions 13 and 15 of the sheet metal strip S from which the bars 5, 7 are formed, i.e. the two layers of the double-layer flange construction 11, are secured together at spaced intervals along the length thereof by tangs 35 struck from the double-layer flange 11, leaving openings 37 in the flange 11, each tang thereby being a double-layer tang and being bent as indicated at 39 to extend through the respective opening 37 away from one face (e.g. the top face) of the flange and back on the other face (e.g. the bottom face) of the flange. As shown in FIG. 6, each tang has a first layer 41 derived from layer 13 of the flange and a second layer 43 derived from the other layer of the flange, the tang being bent back 180° with layer 43 contacting the bottom face of layer 15 of the flange 11, and layer 41 contacting layer 43. The tangs may be spaced at equal intervals all around the frame, the intervals and the tang dimensions being such as securely to fasten the layers 13 and 15 of the flange 11 together.

Figure 2:
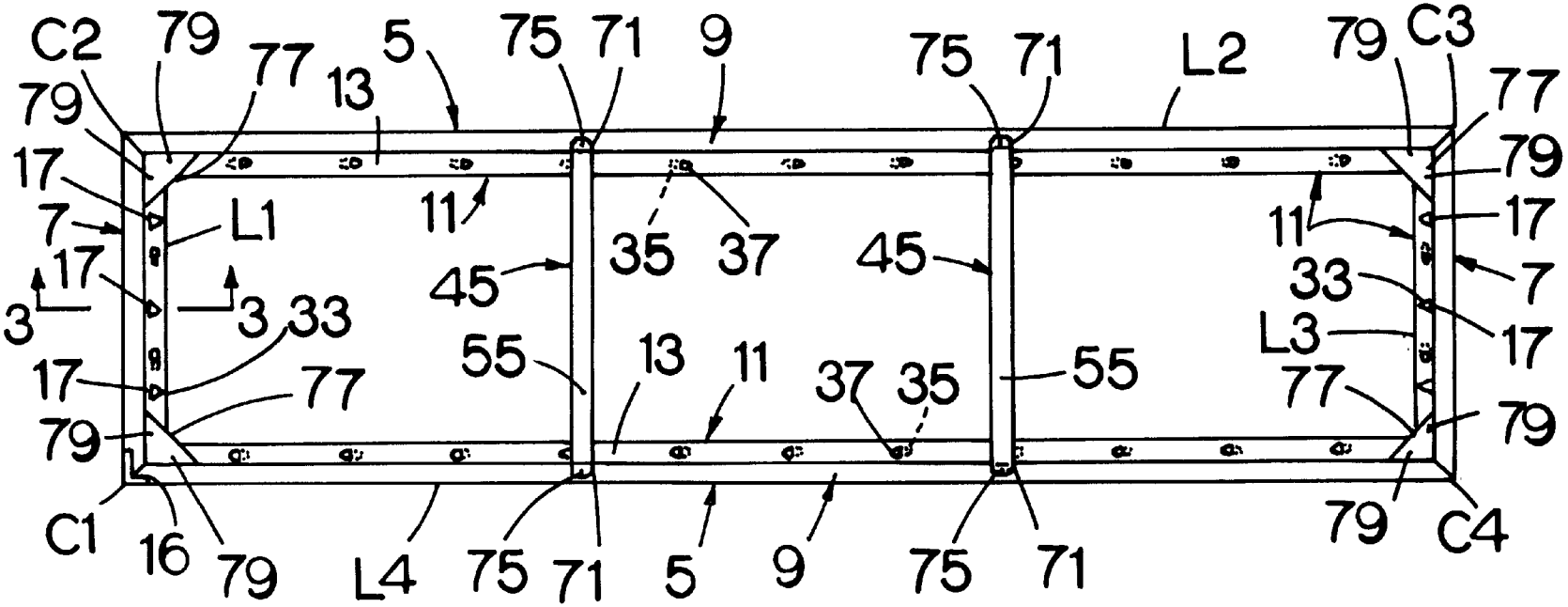
FIG. 2 is a plan of the frame per se of the bed shown on a smaller scale than FIG. 1 so as to show it in full.
Figures 7, 8, 9:
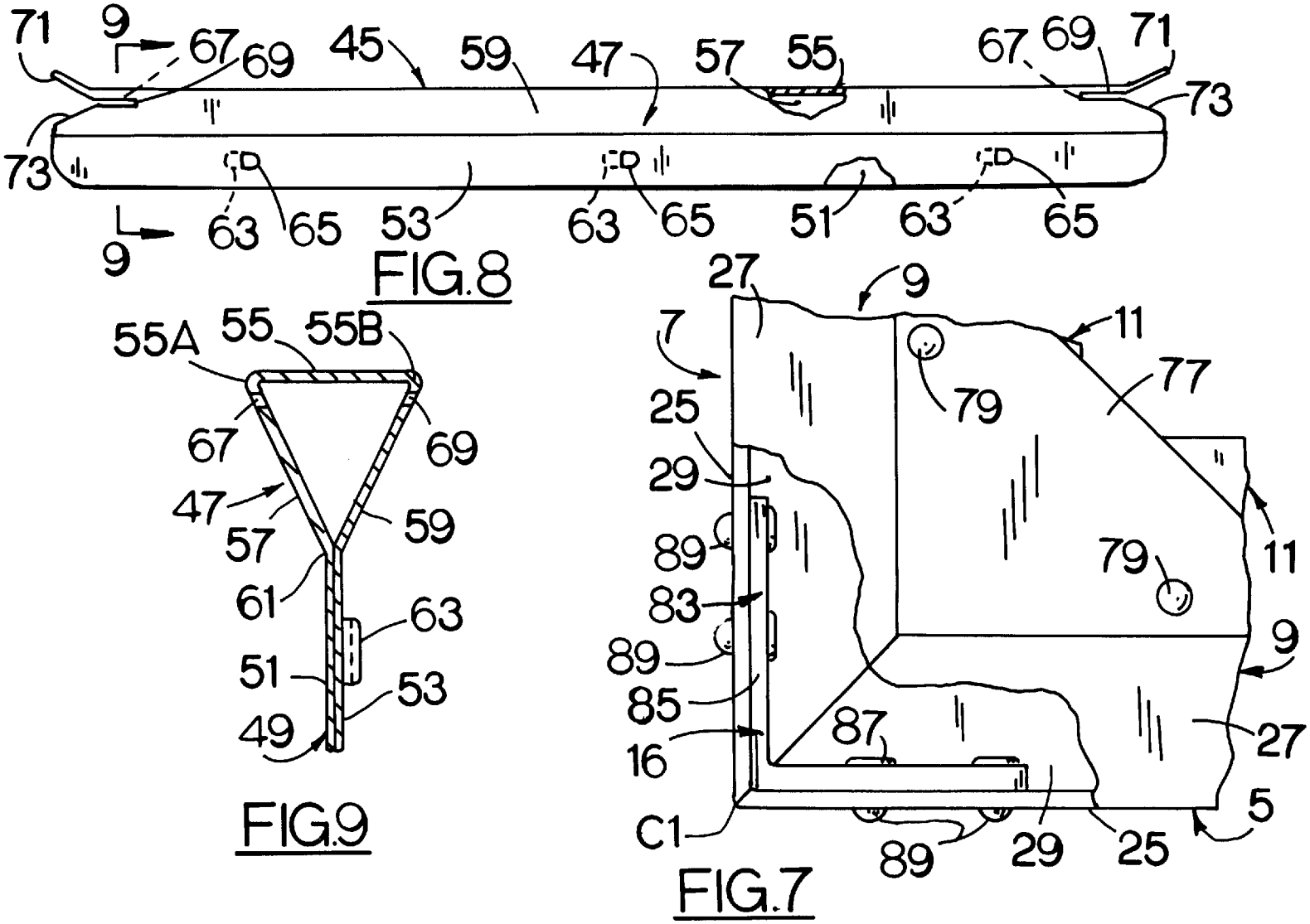
FIG. 7 is an enlarged view of the lower left hand corner of the frame as shown in FIGS. 1 and 2 with parts broken away and shown in section.
FIG. 8 is a view in side elevation of a cross-arm of the bed frame.
FIG. 9 is an enlarged transverse cross-section of the cross-arm generally on line 9—9 of FIG. 8.

As shown in FIGS. 1 and 2, the frame 1 has two cross-arms each generally designated 45 and each extending transversely across the frame from one of the side bars 5 of the frame to the other side bar, these cross-arms being located at the third points of the length of the frame. It is contemplated that having only one cross-arm or more than two is within the scope of the invention, and thus the frame may be referred to as having at least one cross-arm. As shown in FIGS. 8 and 9, each cross-arm 45 comprises a bar formed of sheet metal strip like strip S from which the bars of the frame 1 are formed, each bar 45 being of such overall cross-section as to comprise an upper section 47 shaped to function as a beam having strength in bending resistant to forces transverse thereto, more particularly having strength in bending in a generally vertical plane (and also in a generally horizontal plane), and a lower section 49 constituting a double-layer flange extending downwardly from the upper section comprising a first marginal portion 51 of the sheet metal strip extending downwardly from the upper section superimposed generally flatwise on a second marginal portion 53 of the sheet metal strip extending downwardly from the upper section.

The upper section 47 of each cross-arm is of tubular shape in transverse section (see FIG. 9) and more particularly in the shape of a hollow triangle in transverse section having an upper generally horizontal leg 55 and side legs 57 and 59 converging from the side edges 55*a*, 55*b* of the upper leg toward one another and meeting at a point constituting the apex 61 of the triangle. The aforementioned first marginal portion 51 of the sheet metal strip from which the bars cross-arm is formed extends generally vertically downward from the lower edge of the side leg 57 at said apex 61 and the aforementioned second marginal portion 53 of the strip extends generally vertically downward from the lower edge of the side leg 59 at said apex, these margins being engaged flatwise one with the other. The stated first and second marginal portions 51 and 53 of the sheet metal strip from which the cross-arm is formed, i.e. the two layers of the double-layer flange construction 49, are secured together at spaced intervals along the length thereof by tangs 63 (like tangs 35) struck from the double-layer flange 49, leaving openings 65 in the flange 49, each tang thereby being a double-layer tang and being bent in the same manner as tangs 35. The tangs 63 are spaced at such intervals along the length of the cross-arm and the tang dimensions are such as securely to fasten the layers 51 and 53 of the flange 49 together.

Figure 10:
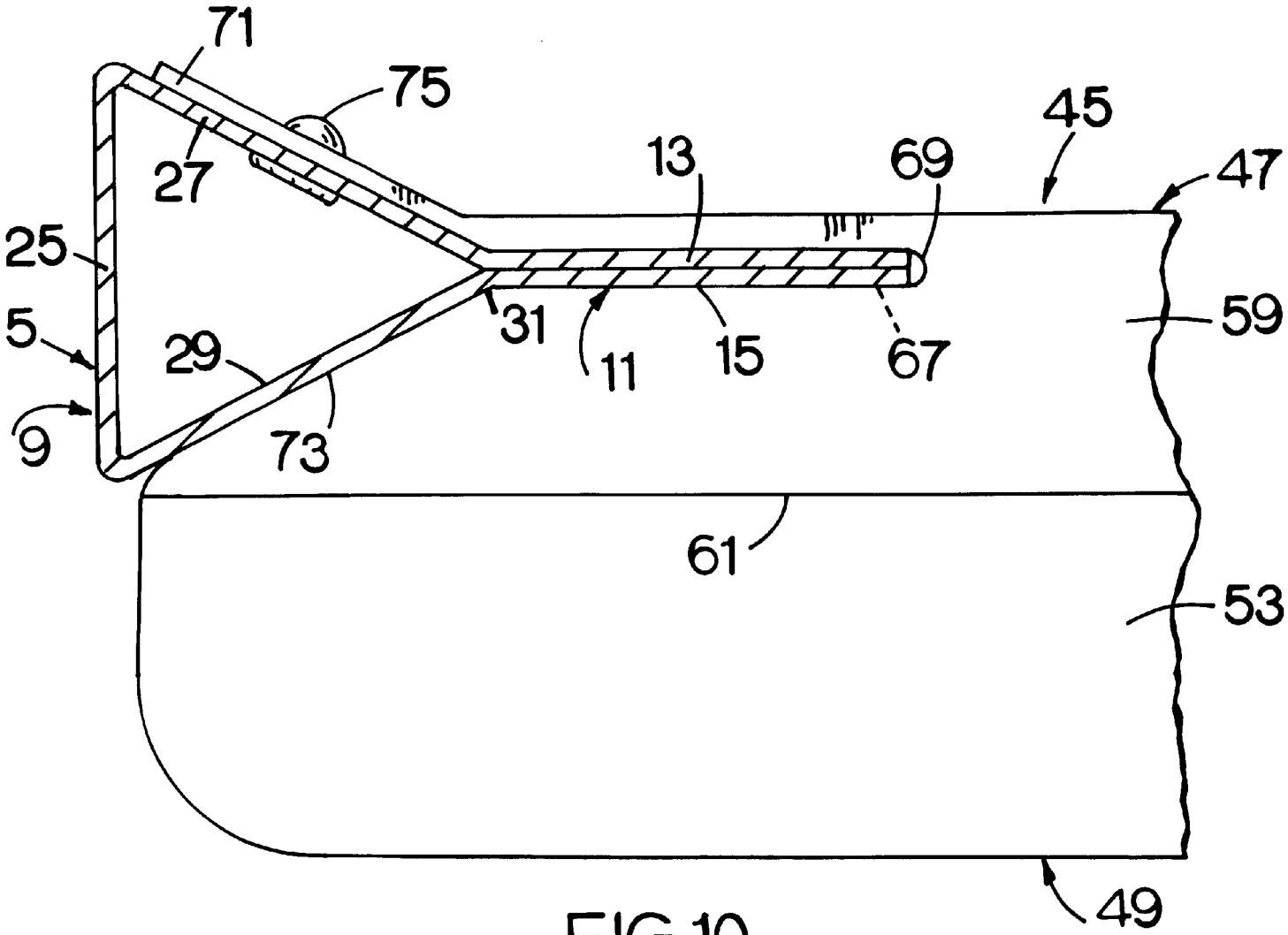
FIG. 10 is a view on a larger scale than FIG. 8 showing how one end of the cross-arm is connected to one of the side bars of the frame.

The cross-arms are slotted at both ends in a horizontal plane just below the upper horizontal leg 55 of the triangular upper part 47 of the cross-arm thereby providing a slot 67 in the side leg 57 and a slot 69 in the side leg 59, end portions 71 of the upper leg being bent to angle upward at an angle matching the angle of inclination of the aforesaid leg 27. Further, the side legs 57 and 59 are cut away at both ends of the cross arms to have upper edges angled as indicated at 73 upwardly and inwardly toward the slots matching the angle of inclination of the aforesaid leg 29, forming with the bent ends 71 of the upper leg 55 a tapered mouth at the respective end of the upper leg. The length of each cross-arm 45 is so related to the width of the frame 1 (i.e. the spacing of the side bars 5 of the frame) as to provide for assembly of each cross-arm with the frame by manipulating the cross-arm into position extending transversely of the frame with flanges 11 of the side bars 5 received in the slots 57 and 59 and with the bent-up ends 71 of the cross-arms engaging leg 27 of the side bar and edges 73 at the ends of the arm engaging the under side of the leg 29 of the side bar, all as shown in FIG. 10. After the cross-arms are thus assembled with the frame they are secured in place as by means of rivets (pop rivets) 75 or self-tapping screws fastening together the bent-up ends 71 of the arms and the upper legs 27 of the side bars as shown best in FIGS. 1 and 10.

Referring to FIGS. 1, 2 and 7 each of the four corners of the rectangular frame 1, indicated at C1, C2, C3 and C4, is reinforced by a gusset 77 constituted by a plate having the shape of a right triangle fitted in the corner on top of the two flanges 11 which meet at the corner and fastened to the flanges by fasteners indicated at 79 such as rivets (pop rivets) or self-tapping screws, driven through the gusset and each of the two flanges.

Figure 11:
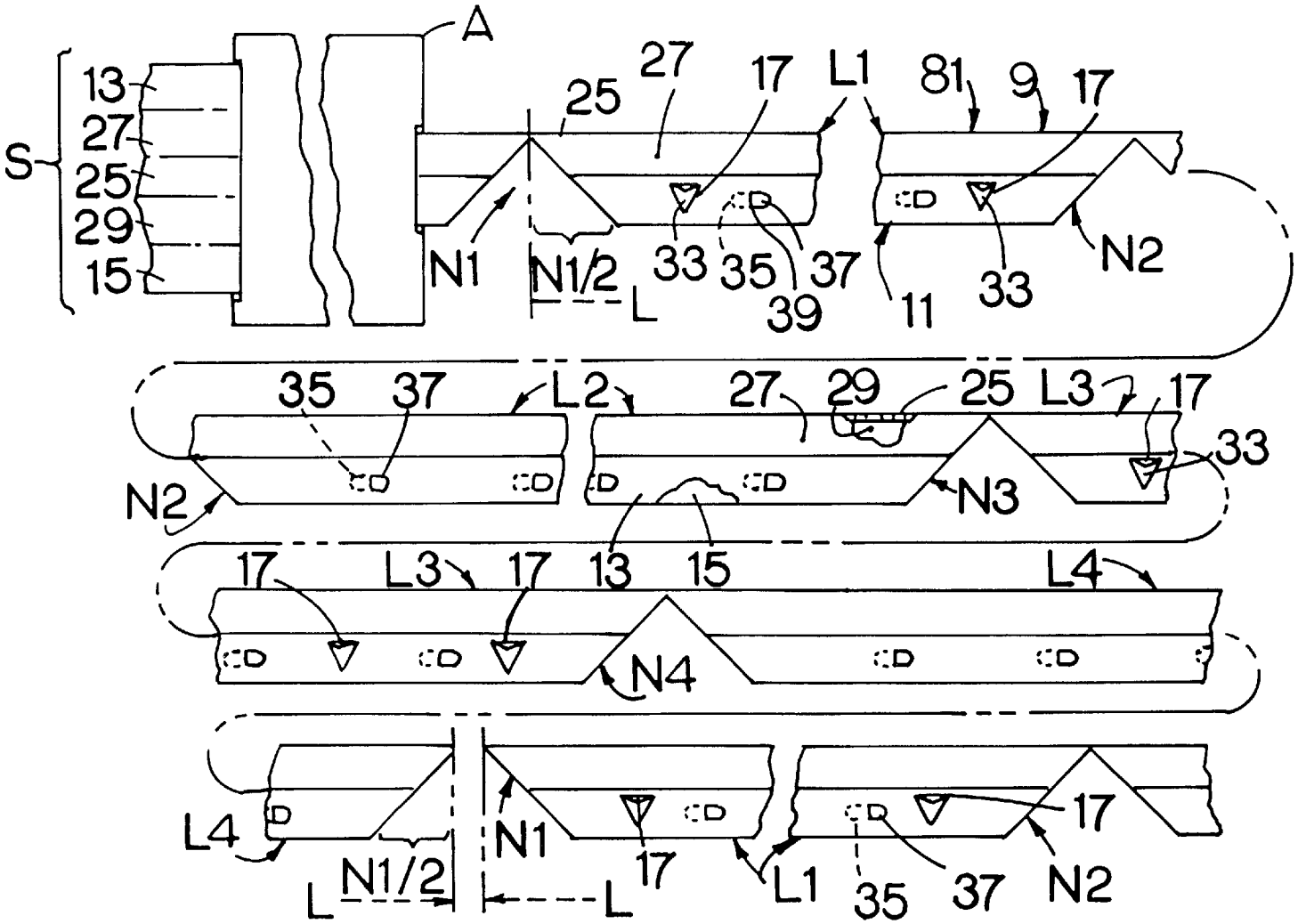
FIG. 11 is a view illustrating the formation of bar stock for forming frames such as shown in FIG. 2 in accordance with a method of the invention.

Referring more particularly to FIG. 11, a method of this invention for manufacturing rectangular bed frames 1 of the invention is shown as comprising cold rolling strip S of sheet metal (e.g. 24 gauge cold rolled steel) into bar stock such as indicated at 81 having the cross-section for the side and end bars 5 and 7 of the frame 1 shown in FIG. 3, thus comprising the outer section 9 of triangular shape to function as a beam with strength in bending in a generally vertical plane and the inner section 11 constituting the double-layer flange extending inwardly from the beam ("outer", "inner" and "inwardly" being in reference to the final disposition of these elements in the completed frame). In the process, the bar stock is notched in the inner section 11 and partly in the outer section 9 with notches generally designated N at intervals such as to define the side bars 5 and end bars 7 of the rectangular frame. The notches are generally of V-shape with the open end of each notch at the edge of the flange 11 of the bar stock and the apex of the V in the outer section 9 of the bar stock, and more particularly with the apex of the V contiguous to the plane of the inside face of the vertical leg 25 of the outer section 9 (the purpose of which will be subsequently described). Also, in the process, integral portions of the flange 11 of the bar stock 81 are struck up at intervals along the length of the stock to form the tabs 17 for attachment to each ultimate frame of the body support 3, and the tangs 35 are struck from the flange 11 of the stock and bent back to fasten together the two layers 13 and 15 of the flange.

In particular, the bar stock S is formed with notches spaced lengthwise thereof at intervals defining single-frame lengths of stock L each of which has a length corresponding to the total length of the periphery of a frame, with each length having a first portion L1 extending from half a V-shaped notch N1 at one end of said length, said half-notch being designated N1/2, to a first full V-shaped notch N2 defining a first end bar 7 of the frame, a second portion L2 extending from the first full V-shaped notch N2 to a second full V-shaped notch N3 defining a first side bar 5 of the frame, a third portion L3 extending from the second full V-shaped notch N3 to a third full V-shaped notch N4 defining the second end bar 7 of the frame, and a fourth portion L4 extending from the third full notch N4 to a half a successive V-shaped notch N1 again designated N1/2 at the other end of said length L defining the second side bar 5 of the frame. The notches may be formed by punching out V-shaped portions of the strip S. The tabs are formed in lengths L1 and L3.

The bar stock is segmented at notches N1 on lines bisecting the V of these notches into the lengths L each corresponding to the total length of the periphery of the frame, comprising length L1 as one of the end bars 7 of the frame, length L2 as one of the side bars 5, length L3 as the other end bar 7 and length L4 as the other side bar 5. Each segmented length L (see FIG. 12) has half a notch N1/2 at each end, and tabs 17 in the end bar portions L1 and L3. As shown in phantom in FIG. 12, each segmented length L is bent 90° at each of notches N2, N3, N4 to form it into the rectangular frame 1, bringing together the N1/2 ends of the length, the notches forming the mitered corners of the frame C1, C2, C3 and C4, corner C1 being the corner where the N1/2 ends are brought together. Here it is to be observed that with the apex of the V-shaped notches contiguous to the inside face of the vertical leg 25 of the frame length L, the bending is facilitated since it essentially involves the bending only of the relatively thin vertical leg 25, unimpeded by any portions of the side legs 27, 29. The meeting ends at corner C1 are secured together by the aforesaid means 16, which as shown best in FIG. 7 more particularly comprises an L-shaped strip 83 of sheet metal having a first arm 85 thereof inserted in the triangular outer section 9 of the end bar 7 and its second arm 87 inserted in the triangular outer section 9 of the side bar 5 at corner C1 lying flat against the inside face of the vertical leg 25 of the triangular outer section 9 of each of these bars, the end portions of the side and end bars at corner C1 being fastened to the arms of the L-shaped strip 83 by suitable fasteners such as rivets 89 (pop rivets) or self-tapping screws or equivalent. The gusset plates 77 and the cross-arms 45 are applied and fastened in place to complete the frame, after which the rectangular piece of plastic netting constituting the body support 3 is applied to the frame by stretching it endwise and hooking it over the tabs 17 on the end bars 7 of the frame, and bending down the tabs on the netting (on the end strands 23*a* of the netting) to fasten the netting to the frame.

Figure 13:
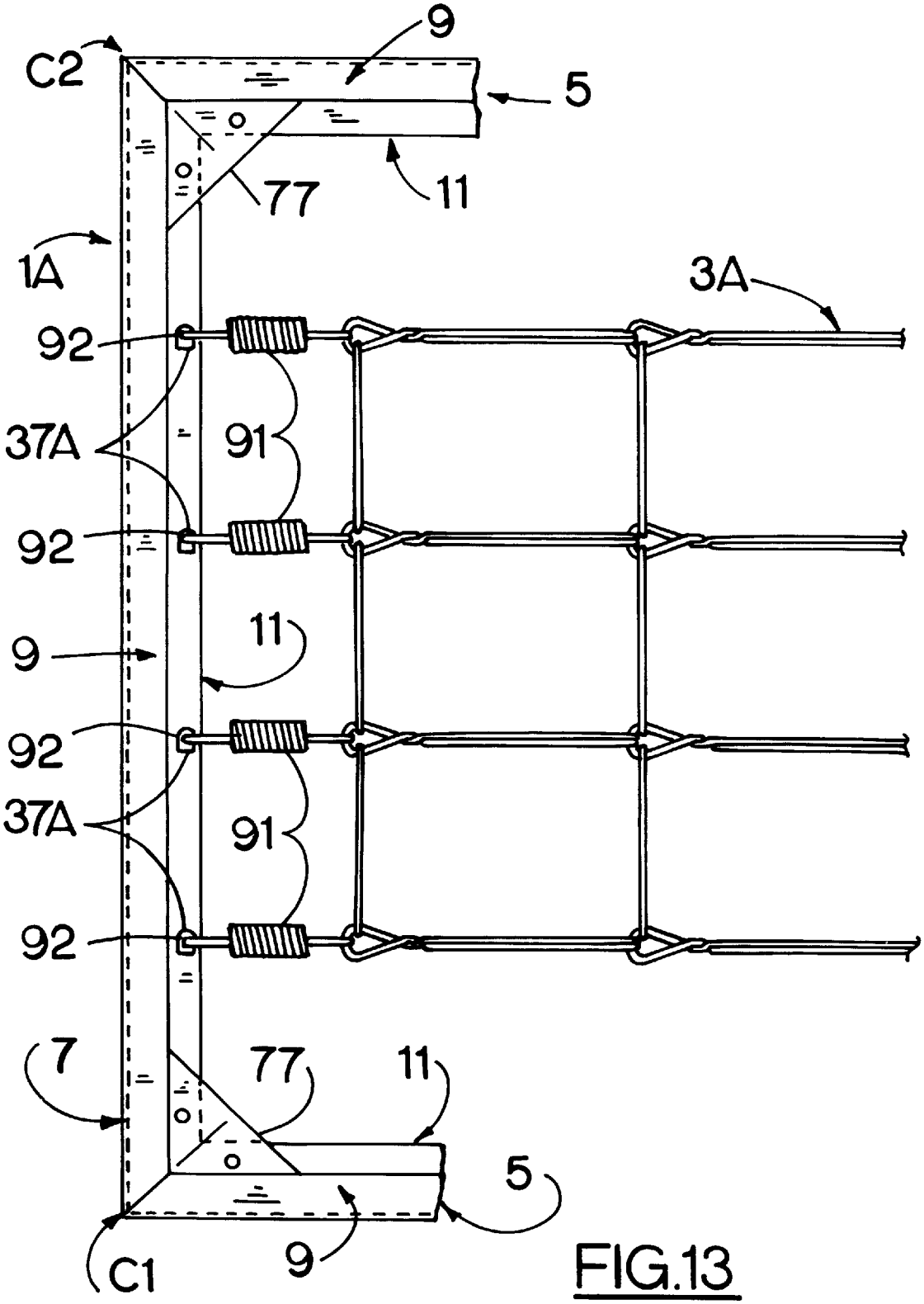
FIG. 13 is a view in plan of part of a modification of the bed of this invention having a wire mesh bed support attached to the frame thereof (instead of a plastic net bed support)

FIG. 13 shows a bed such as contemplated above comprising a frame designated 1A to distinguish it from frame 1 and a wire mesh body support designated 3A to distinguish it from the plastic netting body support 3. As illustrated, the wire mesh of the body support is a conventional type of wire mesh comprising interconnected wire links. The frame 1A is generally the same as the frame 1 with the difference that holes such as indicated at 37A are provided in the flange 11 of each of the end bars 7 of the frame 1A for attachment to the flanges of coil tension springs 91 at the ends of the wire mesh body support 3A (corresponding to the conventional manner of attaching wire mesh body supports to bed frames). The holes 37A, four of which are shown in the end bar 7 appearing in FIG. 13, may be holes corresponding to holes 37 resulting from striking out tangs 35 in the first-described embodiment of FIGS. 1–12, four such tangs being provided along the length of each end bar. The end bars may have tabs 17 as in the frame 1, the tabs not being shown in FIG. 13 and not being used when the wire mesh body support is to be used. The coil springs have hooks at their ends as indicated at 92 by means of which they are hooked into the wire mesh and into the holes 37A.

Figures 14, 15:
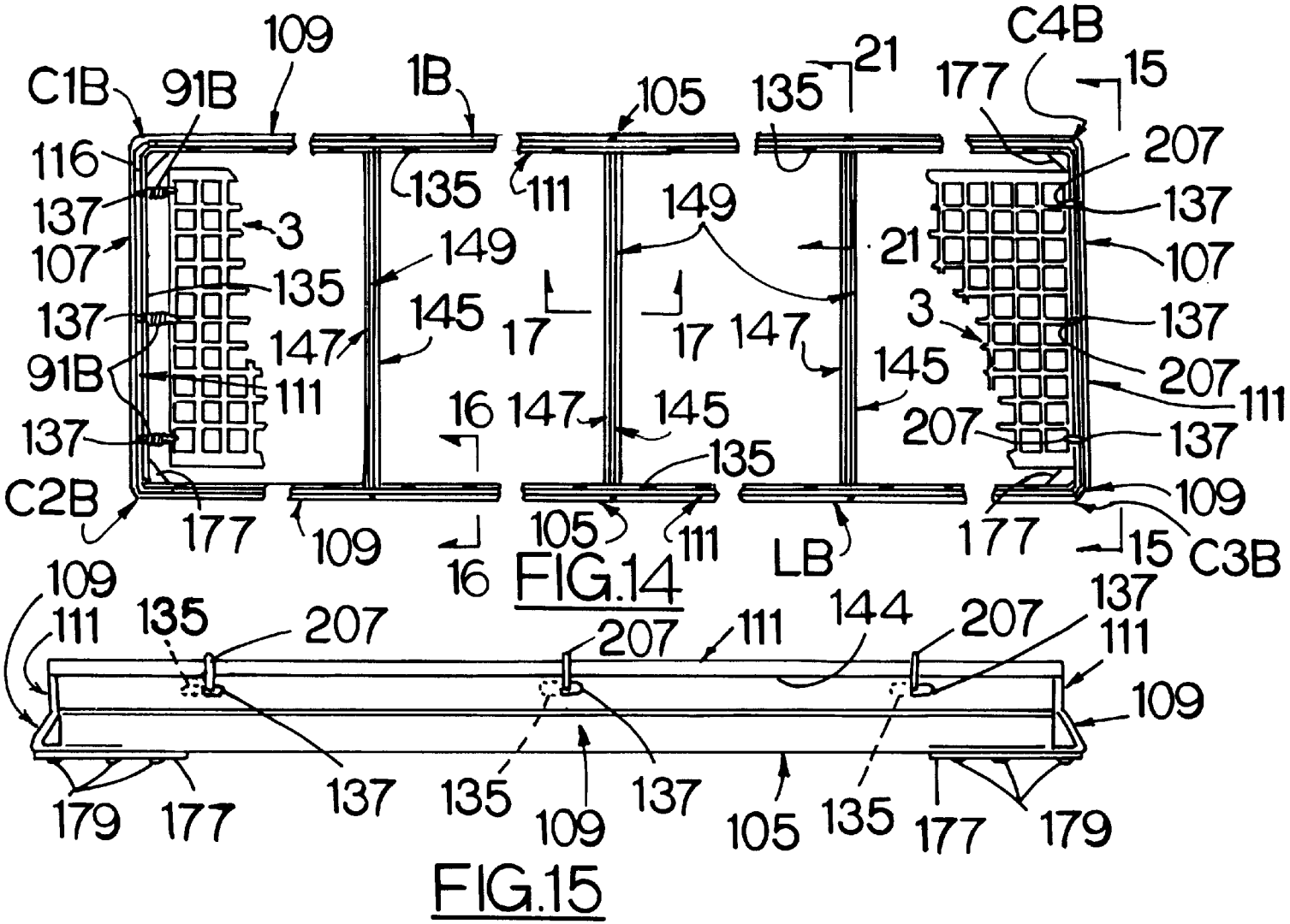
FIG. 14 is a plan of another bed of this invention comprising another modification of the bed frame of this invention, broken away in part to reduce the length of the view and showing the body support of the bed assembled with the frame, the body support again comprising plastic netting and shown broken away.
FIG. 15 is an end elevation of the bed shown in FIG. 14, taken on line 15—15 of FIG. 14.

Referring to FIG. 14 of the drawings, another version of the bed of this invention is shown as comprising a frame of rectangular shape designated in its entirety by the reference numeral 1B to distinguish it from the frame 1 and a body support which may be the same as the plastic netting body support 3 of the first version, and which is again designated in its entirety by the reference numeral 3, supported by the frame within the frame. The frame 1B has sides each designated 105 and ends each designated 107, each of the sides and each of the ends comprising a rail or bar formed of sheet metal strip (e.g. 18 gauge cold rolled steel) having a lower section indicated generally at 109 shaped to function as a beam having strength in bending resistant to forces transverse thereto, more particularly having strength in bending in a generally horizontal plane and also in a generally vertical plane, and an upper section indicated generally at 111 in the form of a flange extending upwardly from the lower section. As shown in detail in FIG. 16, the flange 111 is of double-layer construction comprising a first marginal portion 113 of the sheet metal strip from which the bars are formed superimposed generally flatwise on a second marginal portion 115 of the sheet metal strip.

Figure 19:
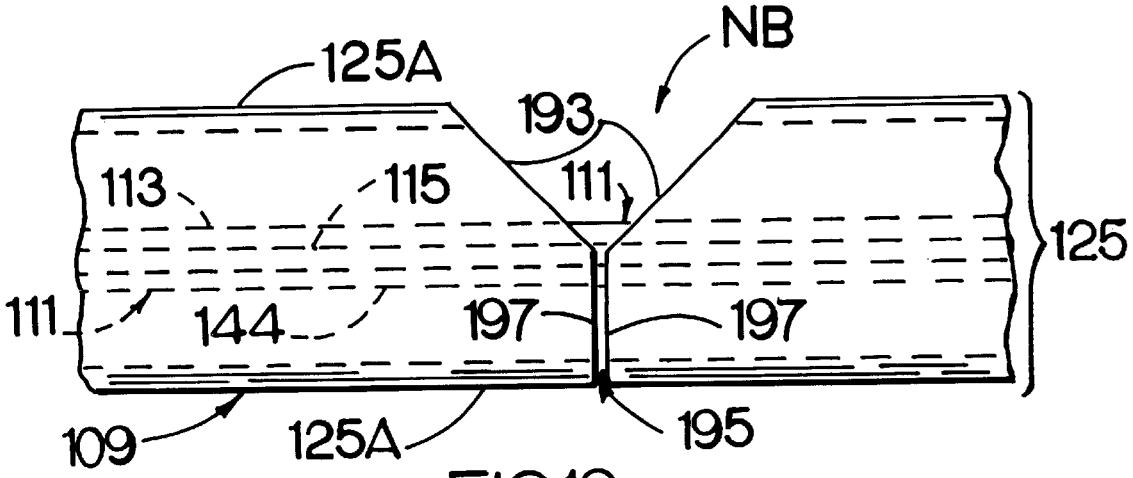
FIG. 19 is a bottom plan of a portion of the bar stock formed by cold-rolling the strip shown in FIG. 18 showing a notch in the stock.

The frame 1B, like the frame 1, is formed by a single member, which may be referred to as a frame length designated in its entirety as LB, bent into the shape of a rectangle thereby forming the bars 105 at the sides of the frame and the bars 107 at the ends of the frame. The four corners of the frame are designated C1B, C2B, C3B and C4B. The ends of said member meet at corner C1B, where they are joined by means generally indicated at 116 in FIGS. 14 and 22. The single member or frame length LB is produced by a method similar essentially to that described above for the frame length L of the frame 1, with notches such as that indicated at NB in FIG. 19 where it is to be bent for forming the corners as mitered corners.

Again, it will be understood that the netting 3 may be of different conformations other than that shown and above described.

Figure 16:
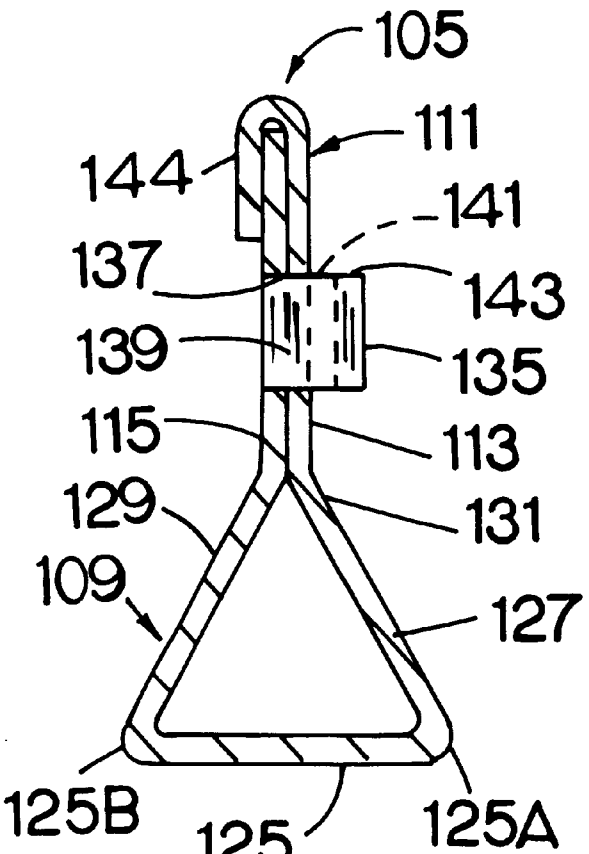

The lower section 109 of each of the side bars 105 and each of the end bars 107 is of tubular shape in transverse section (as shown in FIG. 16 for one of the side bars 105), and more particularly in the shape of a hollow triangle in transverse section having a lower generally horizontal leg 125 and inside and outside legs 127 and 129 converging in upward direction from the inside and outside edges 125*a*, 125*b* of the lower leg toward one another and meeting at a point constituting the apex 131 of the triangle. The aforementioned first marginal portion 113 of the sheet metal strip from which the bars 105, 107 are formed extends generally vertically upward from the upper edge of the inside leg 127 at said apex 131 and the aforementioned second marginal portion 115 of the strip extends generally vertically upward from the upper edge of the outside leg 129 at said apex, these margins being engaged flatwise one with the other. The stated first and second marginal portions 113 and 115 of the sheet metal strip from which the bars 105, 107 are formed, i.e. the two layers of the double-layer flange construction 111 are secured together at spaced intervals along the length thereof by tangs 135 struck from the double-layer flange 111, leaving openings 137 in the flange 111, each tang thereby being a double-layer tang and being bent as indicated at 139 to extend through the respective opening 137 away from one face (e.g. the outside face) of the flange and back on the other face (e.g. the inside face) of the flange. As indicated in FIG. 16, each tang has a first (inner) layer 141 derived from layer 113 of the flange and a second (outer) layer 143 derived from the other layer 115 of the flange, the tang being bent back 180° with layer 141 contacting the face of layer 113 of the flange, and layer 143 contacting layer 141. As in the frame 1, the tangs are spaced at such intervals all around the frame and are so dimensioned as securely to fasten the layers 113 and 115 of the flange 111 together. The layers 113 and 115 are additionally secured together by having the inside layer 113 of greater height than the outside layer 115 and bending the upper margin of layer 113 over on the outside face of layer 115 as indicated at 144.

Figure 17:
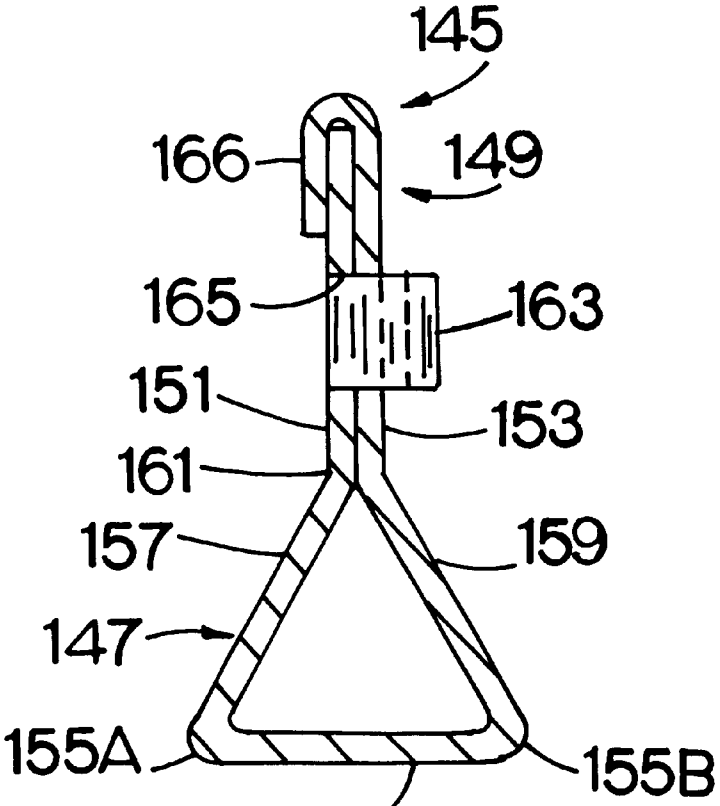
FIGS. 16 and 17 are enlarged cross-sectional views, taken on lines 16—16 and 17—17, respectively, of FIG. 14.
Figure 21:
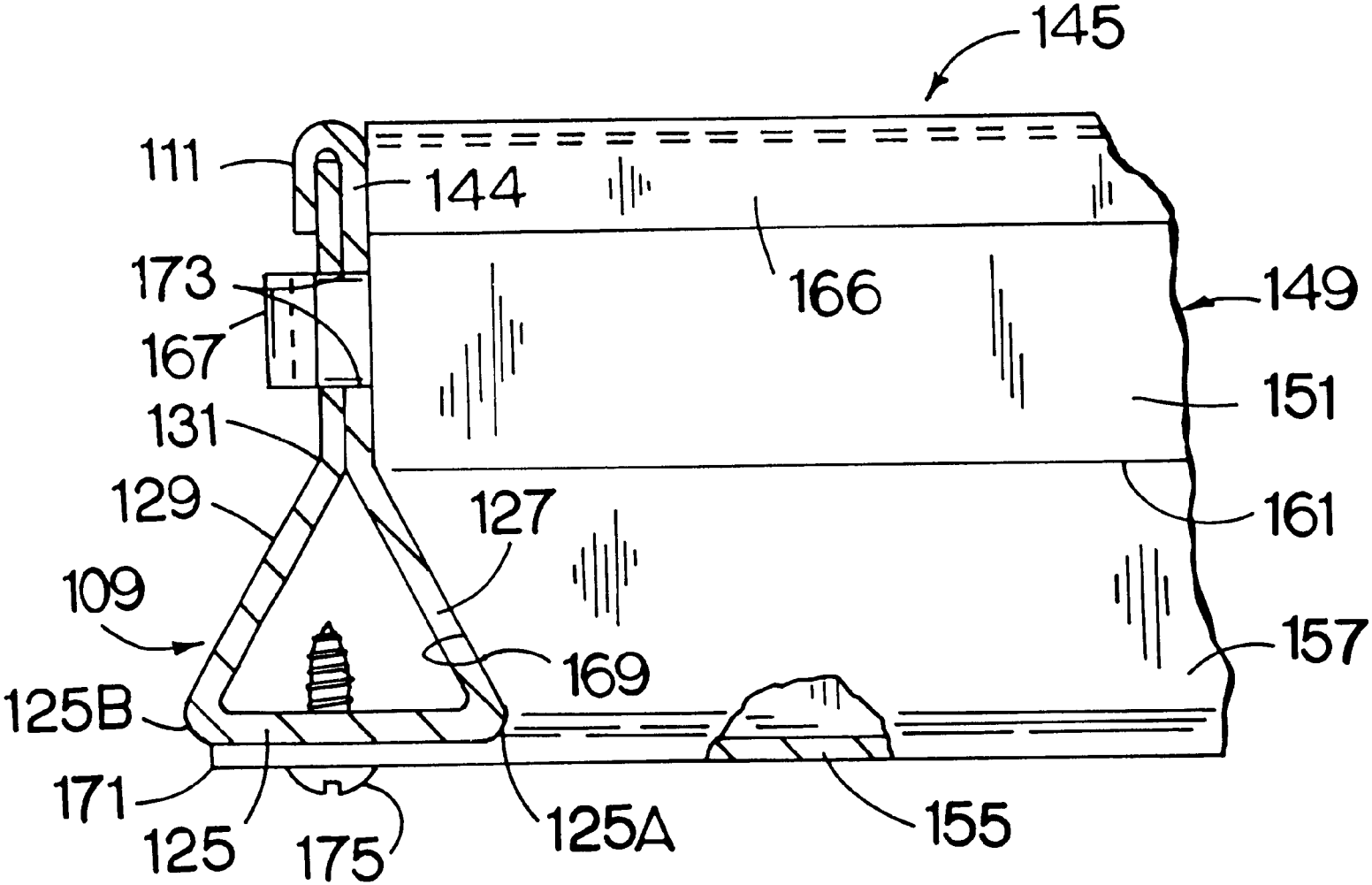
FIG. 21 is a view in section on line 21—21 of FIG. 14 on a larger scale than FIG. 14 showing how each cross-arm of the FIG. 14 frame is attached to the respective side bar of the frame.

As shown in FIG. 14, the frame 1B has three cross-arms, each generally designated 145 to distinguish them from the cross-arms 45 of the frame 1, and each extending transversely across the frame from one of the side bars 105 of the frame 1B to the other side bar, these cross-arms 145 being located at the quarter points of the length of the frame. It is contemplated that having only one cross-arm 145 or two, for example, is within the scope of the invention, and thus the frame may be referred to as having at least one cross-arm. As shown in FIGS. 14, 17 and 21, each cross-arm 145 comprises a bar formed like cross-arm 45 of sheet metal strip, each bar 145 being of such overall cross-section as to comprise a lower section 147 shaped to function as a beam having strength in bending resistant to forces transverse thereto, more particularly having strength in bending in a generally vertical plane (and also in a generally horizontal plane) and an upper section 149 constituting a double-layer flange extending upwardly from the lower section comprising a first marginal portion 151 of the sheet metal strip extending upwardly from the lower section superimposed generally flatwise on a second marginal portion 153 of the sheet metal strip extending upwardly from the lower section.

The lower section 147 of each cross-arm 145 is of tubular shape in transverse section (see FIG. 17) and more particularly in the shape of a hollow triangle in transverse section having a lower generally horizontal leg or base 155 and side legs 157 and 159 converging in upward direction from the side edges 155*a*, 155*b* of the lower leg toward one another and meeting at a point constituting the apex 161 of the triangle. The aforementioned first marginal portion 151 of the sheet metal strip from which the cross-arm is formed extends generally vertically upward from the upper edge of the side leg 157 at said apex 161 and the aforementioned second marginal portion 153 of the strip extends generally vertically upward from the upper edge of the side leg 159 at said apex 161, these margins being engaged flatwise one with the other. The stated first and second marginal portions 151 and 153 of the sheet metal strip from which the cross-arm 145 is formed, i.e. the two layers of the double-layer flange construction 149, are secured together at spaced intervals along the length thereof by tangs 163 (like tangs 63) struck from the double-layer flange 149, leaving openings 165 in the flange 149, each tang thereby being a double-layer tang and being bent in the same manner as tangs 63. The tangs 163 are spaced at such intervals along the length of the cross-arm and the tang dimensions are such as securely to fasten the layers 151 and 153 of the flange 49 together. For additional securement, the layers 151 and 153 are fastened together by having layer 153 originally formed of such height as to project upward beyond the upper edge of layer 151, and bending the upper margin of layer 153 over on layer 151 as indicated at 166 (like lip 144).

Each of the cross-arms 145 is formed with a double-layer tang 167 at each end of the flange 149 extending horizontally outwardly therefrom, each tang 167 comprising a layer extending from layer 151 of the flange and a layer extending from layer 153 of the flange. Further, the side legs 157 and 159 of the lower hollow triangular section 147 of each cross-arm 145 are cut away at each end thereof to have angled end edges as indicated in FIG. 21 at 169 (mitered end edges) matching the angle of inclination of the inside legs 127 of the lower section 109 of the side bars 105. The lower leg or base 155 of the lower section 147 is left intact projecting beyond the mitered edges 169 as indicated at 171 in FIG. 21. The length of each cross-arm 145 is so related to the width of the frame 1B (i.e. the spacing of the side bars 105 of the frame) as to provide for assembly of each cross-arm with the frame by manipulating the cross-arm into position extending transversely of the frame with tangs 167 of the cross-arm of the side bars 105 received in slots 173 in the flanges and with the projecting ends 171 of the lower section of the cross-arm engaging the bottom 125 of the lower triangular section 109 of the side bar, all as shown in FIG. 21. After the cross-arms are thus assembled with the frame they are secured in place as by means of self-tapping screws 175 fastening together the ends 171 of the arms and the bottom of the side bars and bending over the tangs 167 as shown best in FIG. 21.

Figure 22:
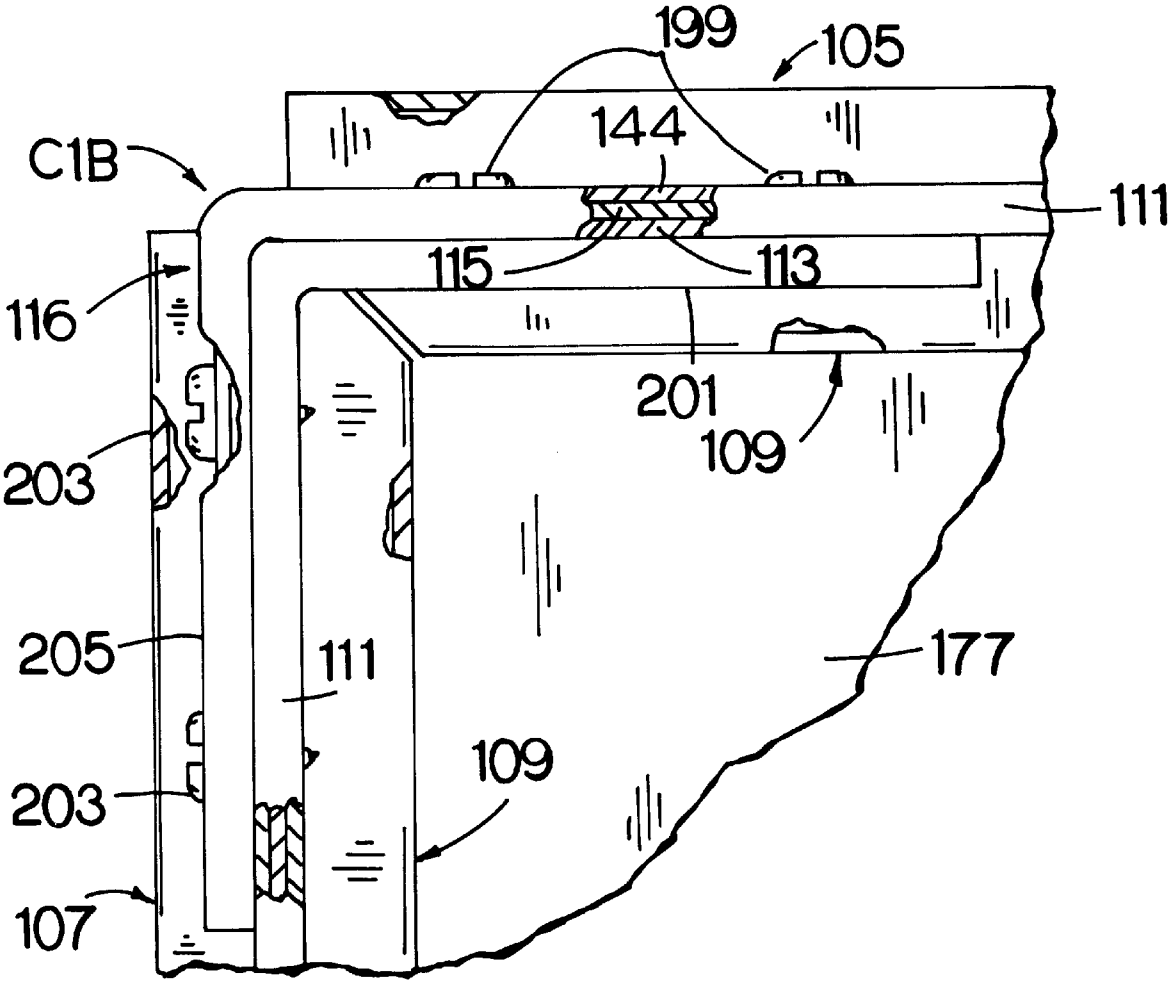
FIG. 22 is a view in plan of the upper left-hand corner of the FIG. 14 frame showing a mode of attachment of the ends of the stock from which the FIG. 14 frame is made, on a larger scale than FIG. 14.

Referring to FIGS. 14, 15 and 22, each of the four corners of the rectangular frame 1B, indicated at C1B, C2B, C3B and C4B, is reinforced by a gusset 177 constituted by a plate generally having the shape of a right triangle underlying the bottom legs 125 of the side and end bars at the corner and fastened to the bottom legs by fasteners indicated at 179 such as self-tapping screws, driven through the gusset and each of said legs.

Figure 18:
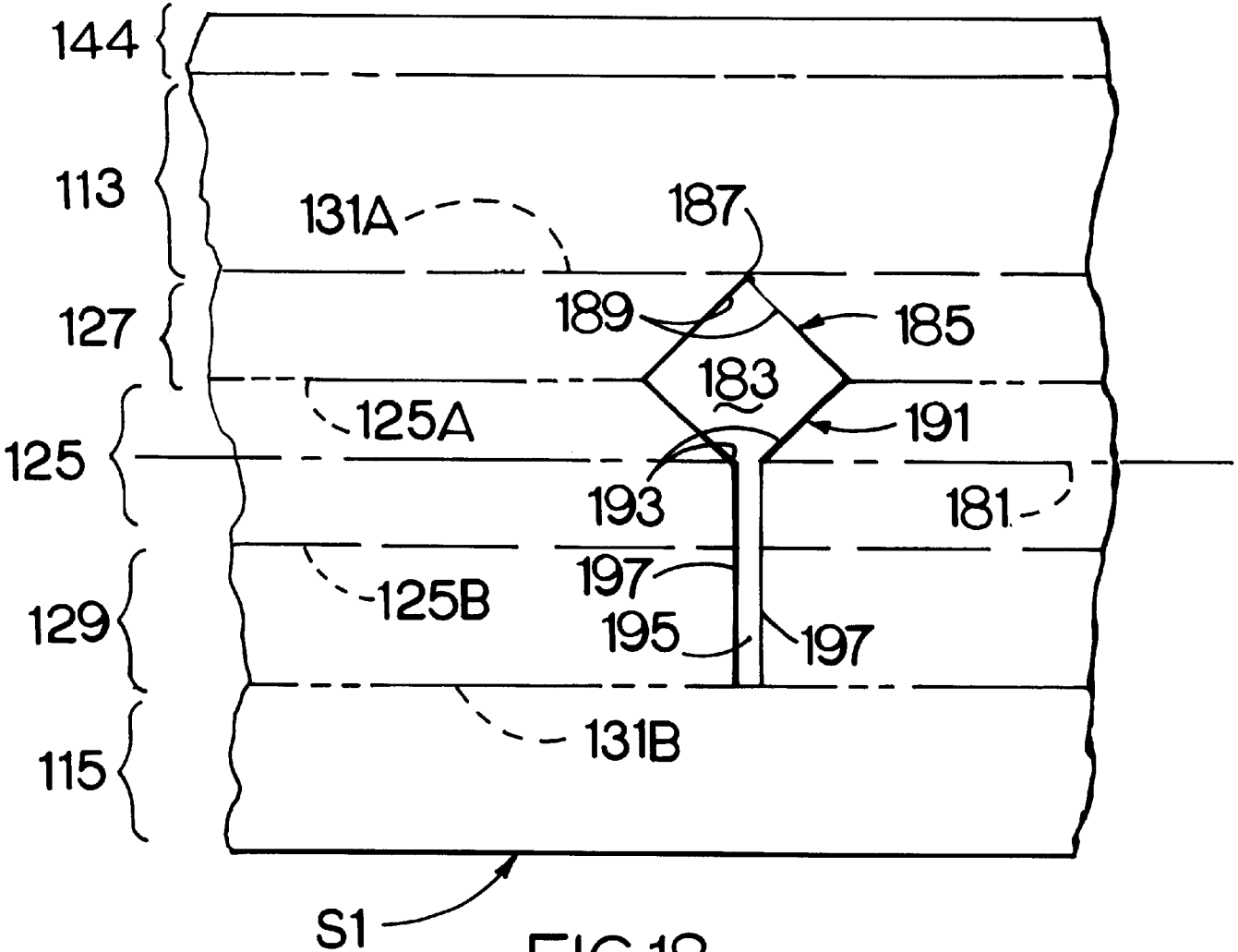
FIG. 18 is a view showing how the strip from which the FIG. 14 frame is made is punched to form notches in the bar stock from which said frame is made.

Rectangular bed frames 1B may be manufactured by a method similar to that herein disclosed for the manufacture of rectangular bed frames 1 comprising cold rolling strip such as indicated at S1 in FIG. 18 of sheet metal (which, for example, may be 18 gauge cold rolled steel, a lighter gauge than the strip S) into bar stock having the cross-section for the side and end bars 105 and 107 of the frame 1B shown in FIG. 16 comprising the tubular lower section 109 of hollow triangular shape in cross section and the two-layer flange 111 extending upward therefrom. As above noted, the flange 111 may be formed with layer 113 initially somewhat wider than layer 115 so that as the strip is rolled layer 113 has marginal portion or lip 144 extending out beyond the edge of layer 115, this margin or lip 144 of layer 113 being folded over on layer 115 to secure the layers together, in addition to the fastening together of the layers by the tangs 135.

Referring to FIG. 18, lines 125*a* and 125*b* are the lines on which the strip S1 is bent in the cold rolling process defining the side edges 125*a* and 125*b* of the lower leg 125 of the hollow-triangular lower section 109 of the stock. Lines 131*a* and 131*b* are the lines on which the strip is bent at the apex 131 of the triangle to bring layers 113 and 115 into flatwise engagement extending upward from the apex of the triangle. Line 181 is the centerline between lines 125*a* and 125*b*. The notches NB are formed by punching holes such as indicated at 183 in the strip S1 at the intervals for the notches.

The parts of the strip which become the bottom leg 125 of the triangular lower section 109, the side legs 127 and 129 of the triangular lower section, the layers 113 and 115 of the flange 111, and the lip 144 are so indicated in FIG. 18. Each of the holes 183 as punched in the strip has a triangular portion 185 in the part 127 with its apex 187 at the line 131*a*, having side edges 189 diverging at right angles to one another to the line 125*a*, a triangular portion 191 in the part 125 with side edges 193 converging from the ends of the side edges 189 on line 125*a* to the center line 181 of part 125*a*, and a slot 195 extending transversely of the strip from the ends of edges 193 on line 181 to the line 131*b*. The sides of the slot are indicated at 197. Thus, the triangular lower section 109 of the bar stock into which the strip S1 is formed is completely cut away at each notch as shown best in FIG.

Figure 20:
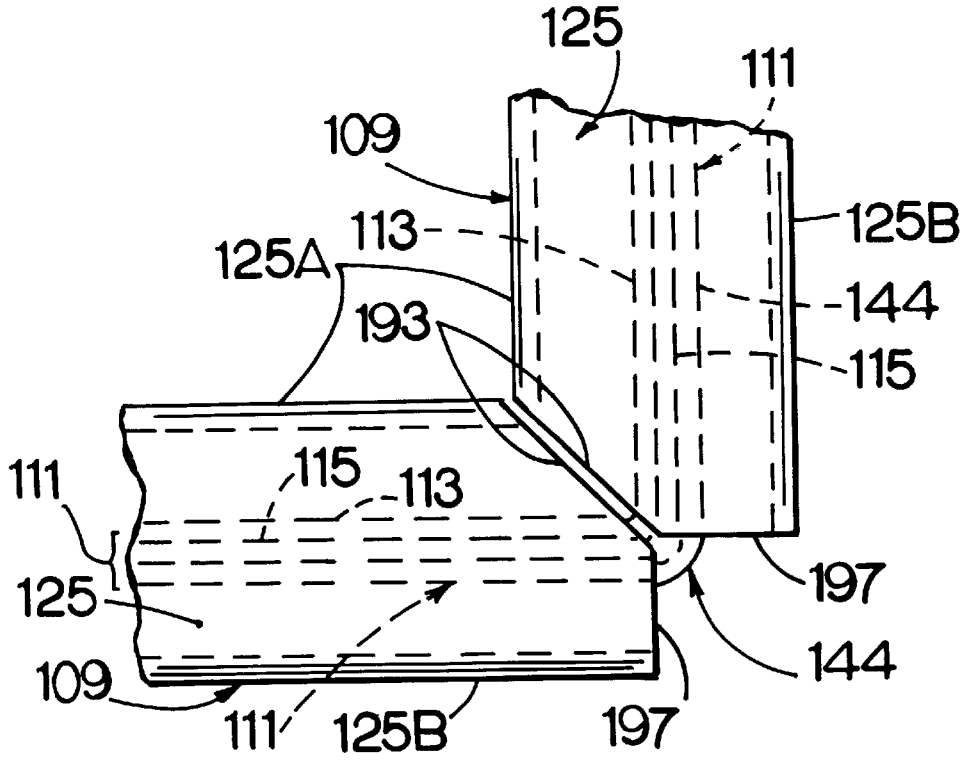
FIG. 20 is a bottom plan of the corner of the frame resulting from the bending of the stock at the notch shown in FIG. 19.

19, the notch having triangular portion 185 of the punched hole 183 in side leg 127 of the triangular lower section, triangular portion 191 and part of slot 195 of the punched hole in the bottom leg 125, and slot 195 entirely across side leg 129. This enables bending the bar stock to be bent at each notch with only the flange 111 being bent, the slot 195 opening up to the point where the sides 197 of the slot are at right angles to one another and the side edges 193 of triangular portion 191 of the punched hole 183 coming together to form a mitered corner, as shown best in FIG. 20.

The bar stock with the notches NB formed from the strip S1 is segmented at notches corresponding to notches N1 shown in FIG. 12 on lines bisecting the notches into lengths LB corresponding to the lengths L shown in FIG. 12 each corresponding to the total length of the periphery of the frame 1B, and comprising sub-lengths corresponding to lengths L1–L4 shown in FIG. 12. Each such segmented length is bent 90° at each of the notches NB corresponding to notches N2, N3, N4 in substantially the same manner as shown for length L in FIG. 12 to form it into the rectangular frame 1B, bringing together the ends of the said length of bar stock, the notches forming the mitered corners C1B–C4B of the frame, corner C1B being the corner where the ends of the length are brought together. Here it is to be observed that the tubular triangular section of the bar stock is in effect completely cut away at each notch, having only the flange 111 to be bent unimpeded by any portions of the tubular section. The meeting ends at corner C1B are secured together by the aforesaid means 116, which may comprise an L-shaped strip similar to the strip 83 to which end portions of the flange 111 of the side and end bars at corner C1B are fastened by suitable fasteners, or which preferably may comprise the arrangement such as shown in FIGS. 14 and 22 involving fastening as by self-tapping screws 199, a projecting end portion 201 of the flange 111 of the end bar at corner C1B bent at right angles to said end bar on the inside of the flange 111 of the side bar at said corner, and fastening as by self-tapping screws 203 of a projecting side portion 205 of the flange 111 of the side bar at corner C1B bent at right angles, to said side bar on the outside of the flange 111 of the end bar at said corner. The gusset plates 177 and the cross-arms 145 are applied, after which the rectangular piece of plastic netting constituting the body support 3 is applied to the frame as by coil tension springs 91B hooked into holes 137 in the end bars at both ends, or by conventional C-clips received in holes 137 in the end bars. FIG. 14 shows said springs 91B at the left end and clips 207 at the right end of the frame 1B for illustrating the alternative use of springs at both ends or clips at both ends.

In certain circumstances, it may be desirable to provide for production of the side bars and end bars of a rectangular bed frame, particularly (but not exclusively) a coffin bed frame of the general type described above, as separate and individual elements, shipped as such to a facility for assembly into frames and distribution thereof, shipment of the separate parts to said facility resulting in considerable cost savings over shipment of assembled frames. The bed frame modification of FIGS. 23 to 32 has been devised for this purpose, utilizing principles of the inventions of FIGS. 1–22 particularly in respect to use of rails or bars formed of sheet metal strip with a cross-section such as shown FIG. 16.

Figure 23:
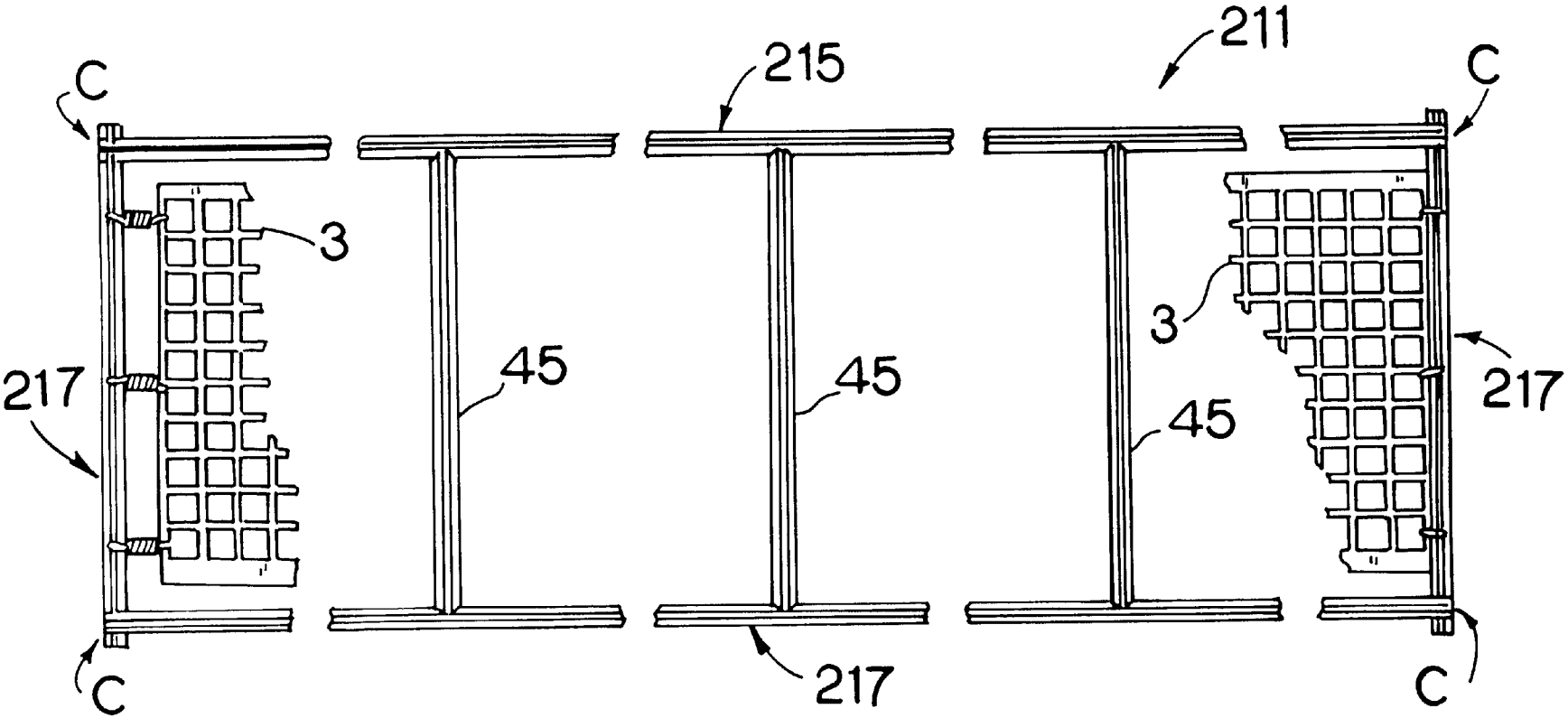
FIG. 23 is a plan of another modification of the bed frame of this invention comprising separate individual side bars and end bars fastened together at each of the four corners of the frame, and broken away in part to reduce the length of the view, portions of the body support which may be used with this modification also being broken away.

Referring first to FIG. 23, a bed frame devised for the stated purpose and for other purposes including simplified and economical assembly of the separate and individual side bars and end bars to form frames is designated in its entirety by the reference numeral 211 wherein it is shown to be of rectangular shape having four corners, each indicated at c, and to comprise a pair of side bars each designated in its entirety by the reference numeral 215 and a pair of end bars each designated in its entirety by the reference numeral 217. Each bar of each of these pairs is, per se, a separate and individual bar (instead of part of a frame length L as above described), the bars of one pair extending at their ends over the bars of the other pair at their ends at the four corners C of the frame. More particularly, as shown, the side bars 215 extend at their ends over and above the end bars 217 at their ends at the four corners C of the frame, where they are fastened together in a manner to be described. Bars 215 and bars 217 may conveniently be produced at one facility, and bundled and shipped economically to another facility for assembly, involving the fastening together to form frames such as the frame 211, each comprising the pair side bars 215 and the pair of end bars 217 fastened together at ends at the four corners C of the frame.

Figure 25:
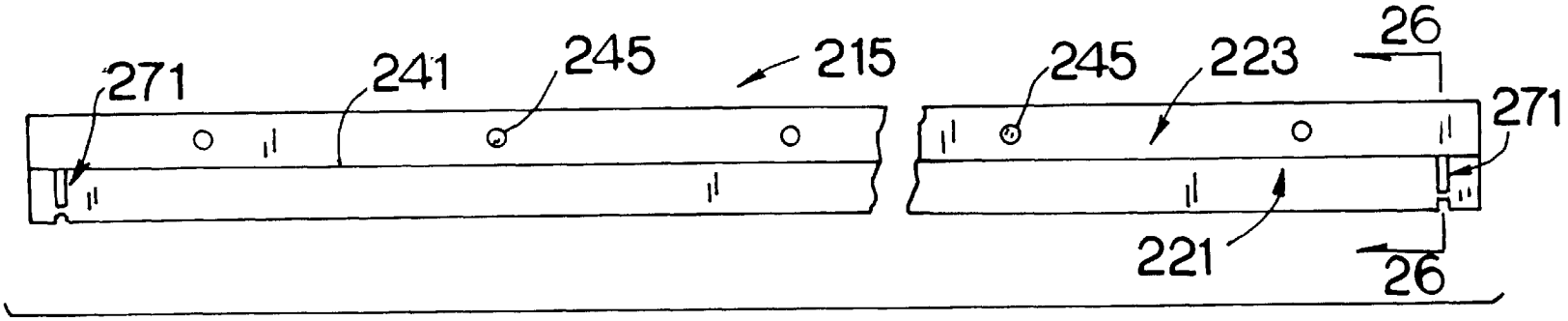
FIG. 25 is an elevation of a side bar of the frame.
Figure 25A:
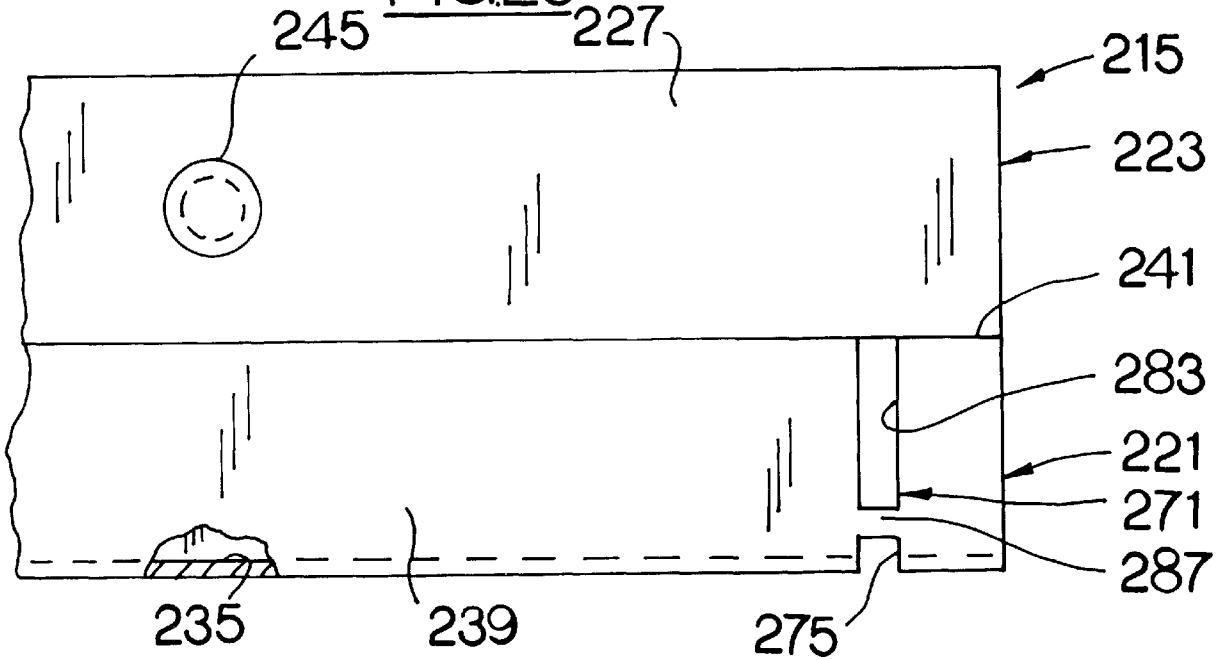
FIG. 25A is an enlarged elevation of one end of the side bar of FIG. 25.
Figure 26:
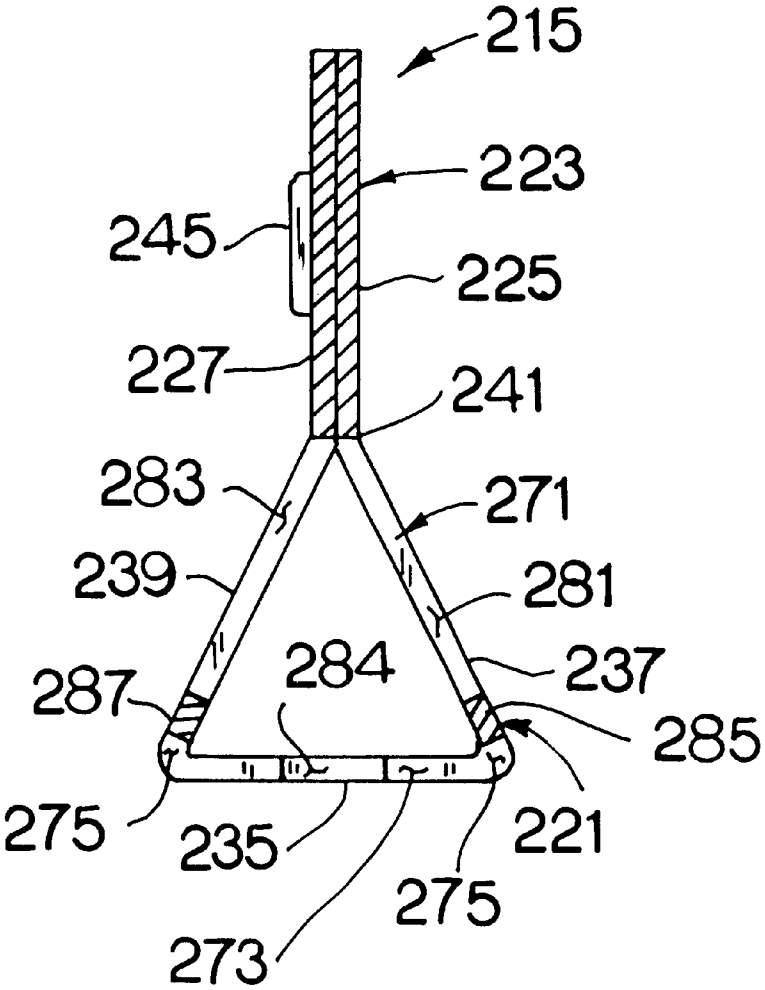
FIG. 26 is an enlarged vertical transverse section on lines 26—26 of FIG. 25.

As shown best in FIGS. 25, 25A and 26, each of the side bars 215 is formed of sheet metal strip (e.g. 18 gauge cold rolled strip) having a lower section indicated generally at 221 shaped to function as a beam having strength in bending resistant to forces transverse thereto, more particularly having strength in bending in a generally horizontal plane and also in a generally vertical plane, and an upper section indicated generally at 223 in the form of a flange extending upwardly from the lower section. As shown in detail in FIG. 26, the flange 223 is of double-layer construction comprising a first marginal portion 225 of the sheet metal strip from which the bar is formed superimposed generally flatwise on a second marginal portion 227 of the sheet metal strip.

The lower section 221 of each of the side bars 215 is of tubular shape in transverse section and more particularly in the shape of a hollow triangle in transverse section having a lower generally horizontal leg 235 and inside and outside legs 237 and 239 converging in upward direction from the inside and outside edges of the lower leg toward one another and meeting at a point constituting the apex 241 of the triangle. The aforementioned first marginal portion 225 of the sheet metal strip from which the bar 215 is formed extends generally vertically upward from the upper edge of the inside leg 237 at the apex 241 and the aforementioned second marginal portion 227 of the strip extends generally vertically upward from the upper edge of the outside leg 239 at the apex, these margins being engaged flatwise one with the other. The stated first and second marginal portions 225 and 227 of the sheet metal strip from which the bar 215 is formed, i.e. the two layers of the double-layer flange construction 111, are secured together at spaced intervals by suitable fasteners 245.

Figure 24:
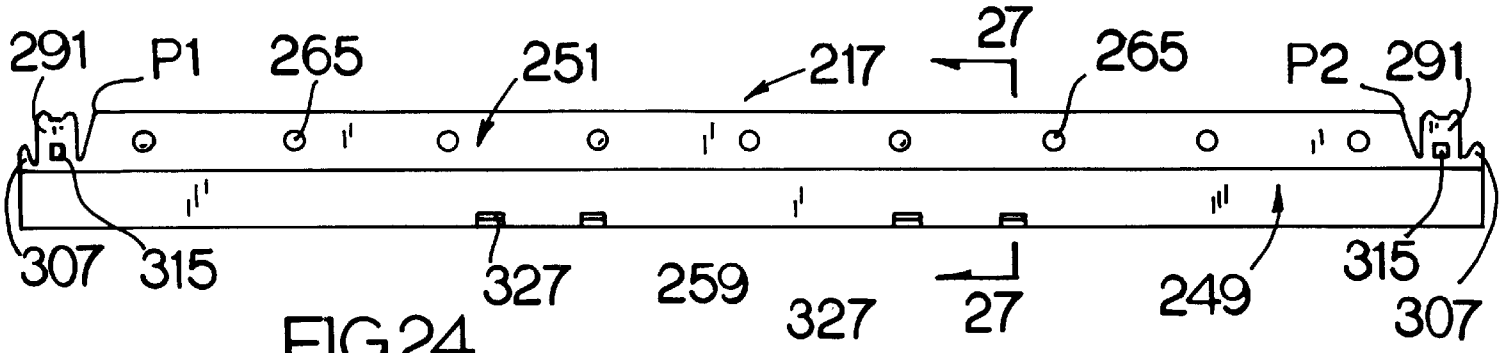
FIG. 24 is an elevation of an end bar of the frame.
Figure 24A:
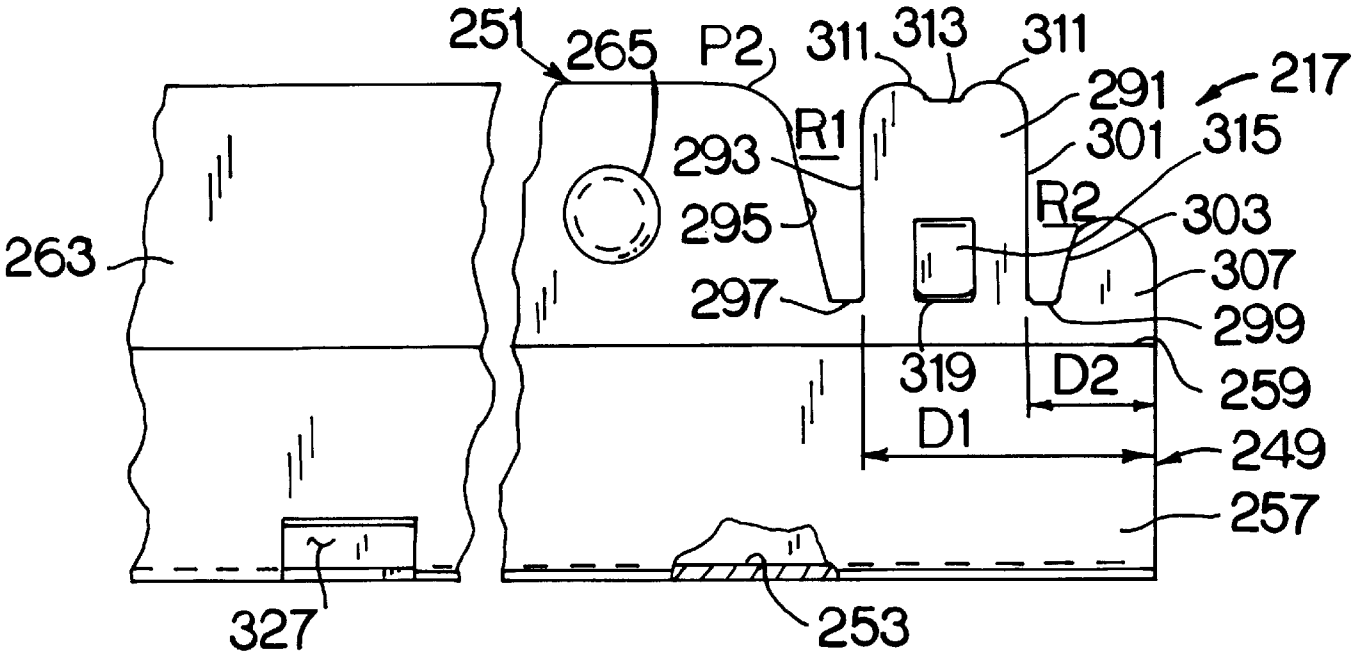
FIG. 24A is an enlarged elevation of one end of the end bar of FIG. 24.
Figure 27:
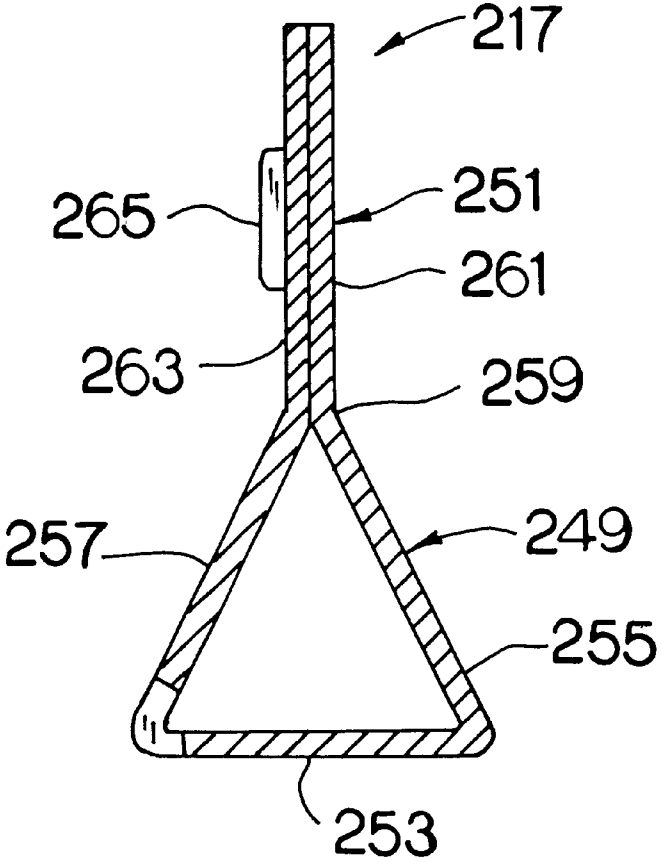
FIG. 27 is an enlarged vertical transverse section on lines 27—27 of FIG. 24.

Similarly, as shown in FIGS. 24, 24A and 27, each of the end rails 217 has a lower section generally designated 249 of tubular shape in transverse section and an upper section generally designated 251 in the form of a flange extending up from the lower portion. More particularly, the lower section is in the shape of a hollow triangle in transverse section having a lower generally horizontal leg 253 and inside and outside legs 255 and 257 converging in upward direction from the inside and outside edges of the lower leg toward one another and meeting at a point constituting the apex 259 of the triangle. A first marginal portion 261 of the sheet metal strip from which the bar 217 is formed extends generally vertically upward from the upper edge of the inside leg 255 at said apex 259 and a second marginal portion 263 of the strip extends generally vertically upward from the upper edge of the outside leg 257 at said apex, these margins being engaged flatwise one with the other to from the upper section 251 of the bar. The stated first and second marginal portions 261 and 263, i.e. the two layers of the double-layer flange construction 111, are secured together at spaced intervals by suitable fasteners 265.

The tubular lower section 221 of each side bar 215, which as above noted is generally of the shape of a hollow triangle in transverse cross-section is slotted adjacent each end thereof, having a slot formation indicated in its entirety by the reference numeral 271 adjacent each end. In detail (FIGS. 25A and 26), each slot formation comprises a transverse slot 273 in the base 235 of the triangle, extending partly into the side legs 237 and 239 of the triangle as indicated at 275, and slots 281 and 283 in the side legs 237 and 239 respectively, generally coplanar with the slot 273 in a transverse plane of the end bar, i.e. plane generally perpendicular to the side bar. The slot 273 in the base 235 of the triangle is defined by a pair of side edges, both of which are notched (FIGS. 26 and 28) to provide clearance openings 284, the purpose of which will be explained later. The lower ends of the slots 281 and 283 in the side legs 237, 239 are spaced a relatively short distance (compared to the length of the side legs) from the ends 275 and 275 of the transverse slot 273, and the slots 281, 283 extend up from their said lower ends generally to the apex 241 of the triangle, i.e. to the juncture of the side legs at the upper ends of the side legs. The slotting is such as to leave integral bridge portions 285 and 287 of the side legs 237 and 239, respectively, bridging the slots, i.e. interconnecting the portions of the side legs on opposite sides of the slots in the side legs to maintain the integrity of the tubular section of the side bar. The flange 223 of each side bar, comprising layers 225 and 227, preferably extends continuously at full uniform height from one end of the side bar to the other, as shown in FIG. 25.

Figure 32:
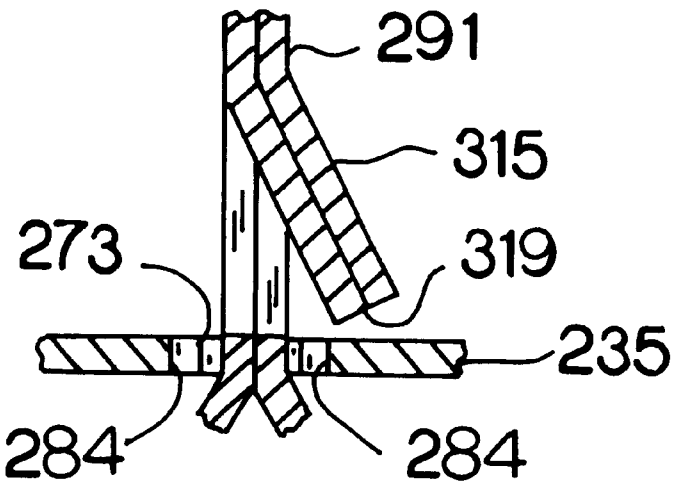
FIG. 32 is a view similar to FIG. 31 showing the detent bent to a position for retaining the end and side bars in assembly.
Figure 31:
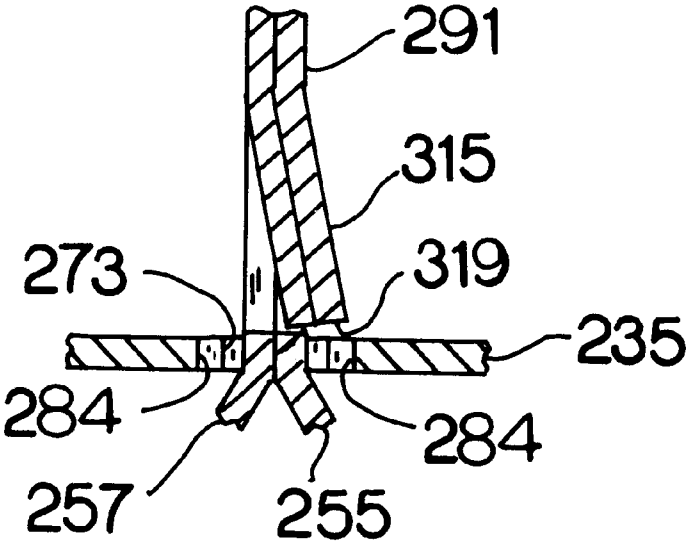
FIG. 31 is a partial sectional view on lines 31—31 of FIG. 30 illustrating passage of a detent on the tongue of an end bar through an opening in a corresponding side bar.

The tubular section of each end bar 217, here again as above noted, is generally in the shape of a hollow triangle in transverse cross-section, the triangle having a generally horizontal base 253 and side legs 255 and 257 converging from the edges of the base toward one another and meeting at a point constituting the apex 259 of the triangle. As shown in FIGS. 24 and 24A, the flange 251 of each of the end bars, comprising layers 261 and 265, extends with its full height continuously from a point P1 spaced inward from but adjacent one end of the end bar to a point P2 spaced inward from but adjacent the other end of the end bar, and is specially formed between each of points P1 and P2 and the respective end of the end bar with a formation such as to provide a portion of the flange 251 as a tongue 291 spaced inward from but adjacent the respective end of the end bar. Each tongue is formed by, in effect, cutting away a portion of the flange (both layers) leaving a recess R1 in the flange having an edge 293 spaced a distance D1 (FIG. 24A) from the end of the end bar defining an inner side edge of the tongue 291 and an inclined edge 295 spaced further from the end of the end bar, the recess R1 having a lower end 297 spaced somewhat above and adjacent the apex 259 of the triangle, and cutting away an end portion of the flange (both layers) leaving a shallower recess R2 in the flange 251 having an edge 301 spaced a distance D2 from the end of the end bar defining an outer side edge of the tongue and an inclined edge 303 adjacent the end of the end bar defining a flange end portion 307 of reduced height relative to the full flange height of the flange between points P1 and P2. The recess R2 has a lower edge 299 spaced somewhat above and adjacent the apex 259 of the triangle at the same level as the lower edge 297 of recess R1. The tongue 291, which rises generally to the full height of the flange 251, has an upper end defined by two rounded end edges 311 and a depressed flat central horizontal edge 313 extending between the two end edges. A rectangular flap 315 is struck from the lower part of the tongue so that it angles down and laterally out from the plane of the tongue at one side of the tongue, as best illustrated in FIG. 31. The flap 315, which functions as a detent in a manner to be described hereinafter, has generally parallel side edges and a lower edge 319 (FIG. 32).

Figure 29:
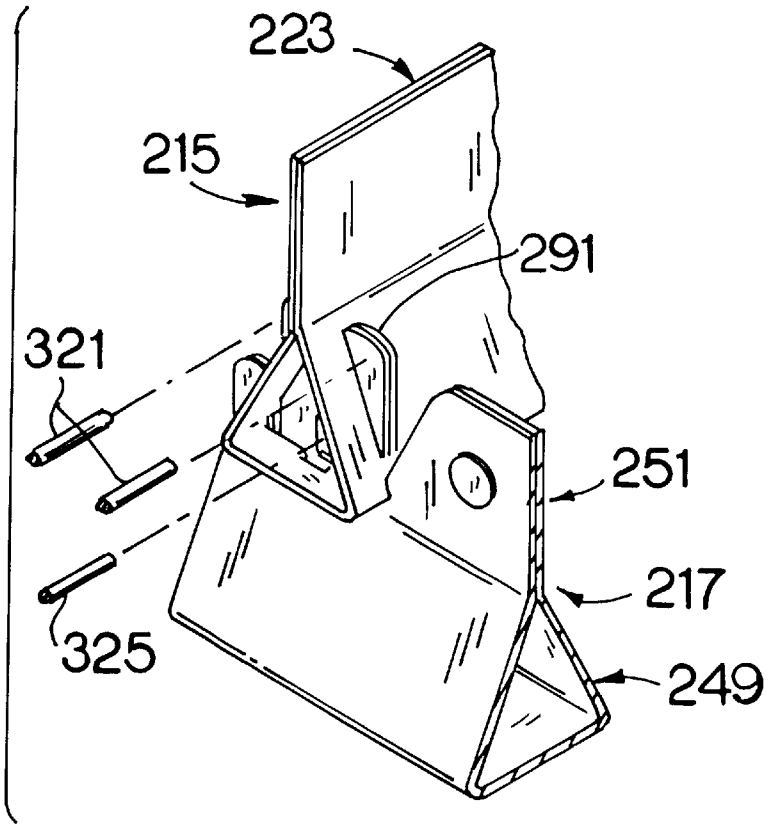
FIGS. 28 and 29 are partial perspective views illustrating the assembly of an end rail and a side rail at one corner of the frame.
Figure 28:
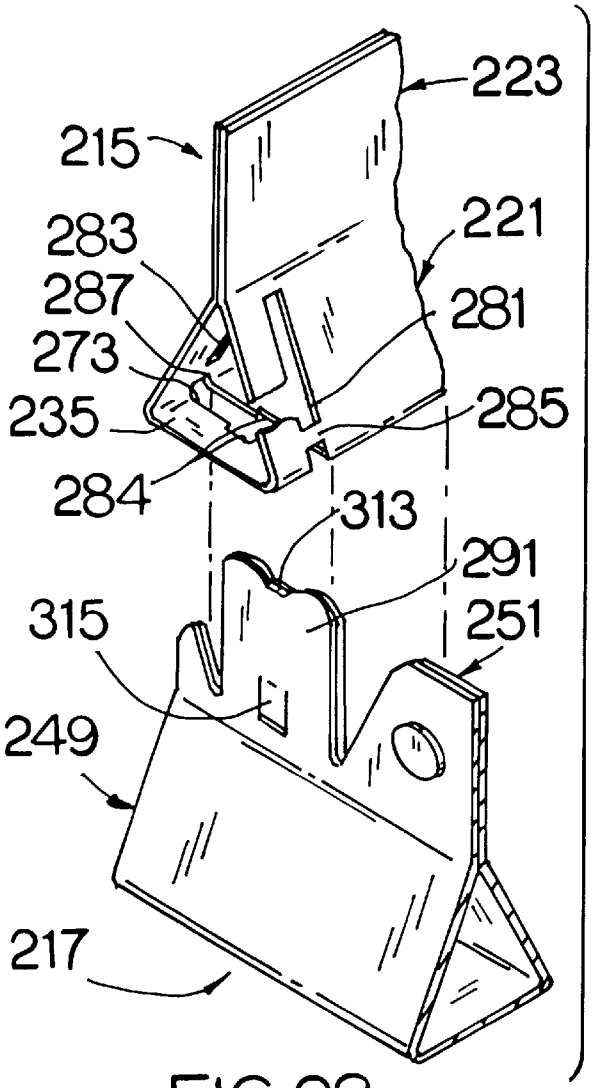
Figure 30:
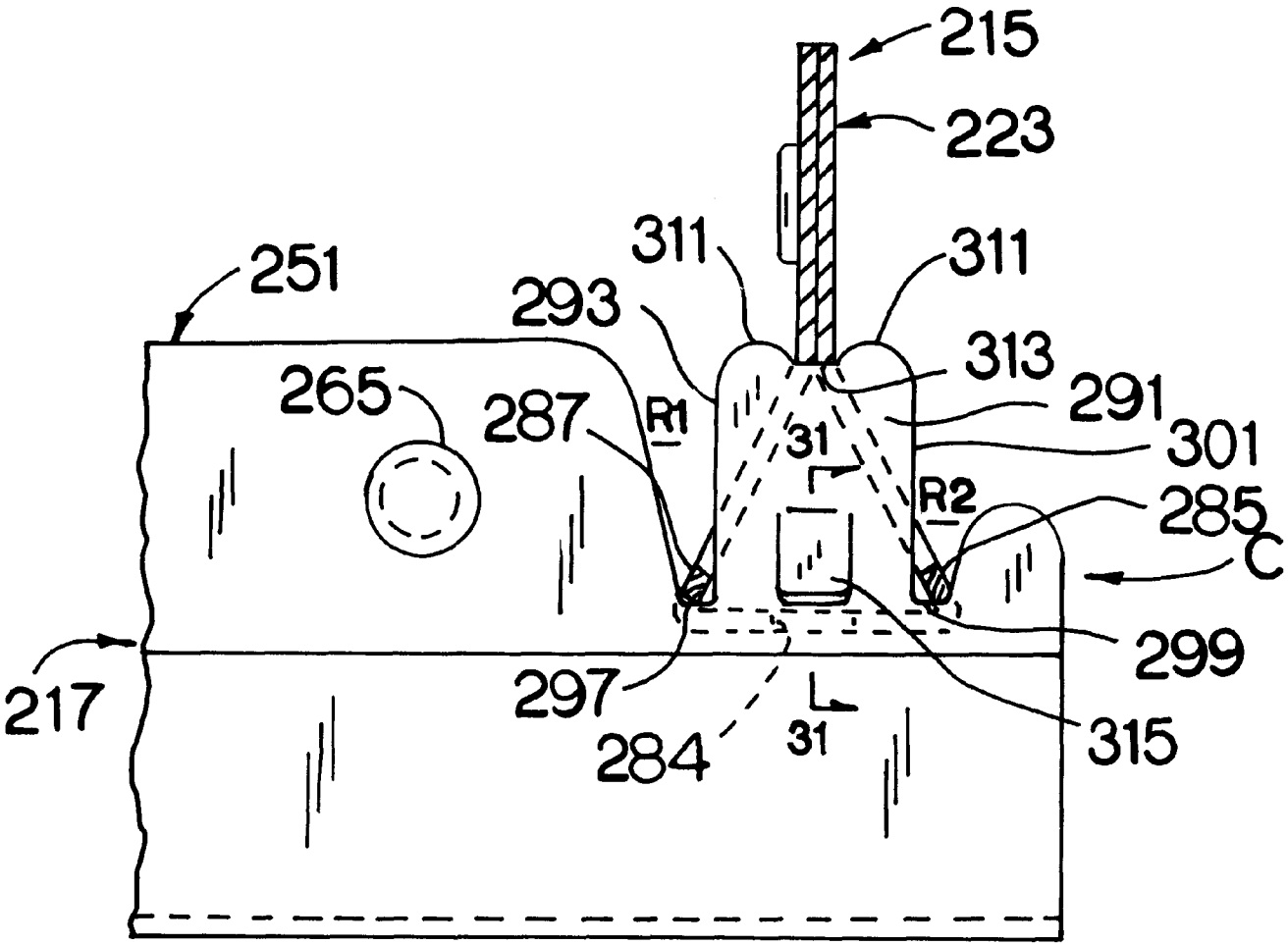
FIG. 30 is a partial elevational view illustrating a tongue on an end bar received in a slot in a side bar at one corner of the frame.

FIGS. 28–30 illustrate how an end bar 217 and a side bar 215 are assembled at a corner C of the bed frame. When the two bars are assembled, the tongue 291 adjacent a respective end of the end bar extends up through the slot 273 in the base 235 and the slots 281, 283 in the side legs 237, 239 of the triangle of the side bar overlying the end bar, and the bridge portions 285, 287 of the side bar are received in respective recesses R1, R2 in the end bar in positions immediately above or engaging the lower edges 299, 297 of the recesses R1, R2. As shown in FIG. 30, the dimensions and contours of the parts are such that an edge of the side bar (corresponding to apex 241) at the upper ends of the slots 281, 283 in the sides of the legs 237, 239 seats against the flat edge 313 of the tongue, so that the tongue bears the weight of the side bar 215 and its corresponding static and dynamic load. If this load is sufficient, the tongue may buckle to a limited extent, causing the bridge portions 285, 287 of the side rail to move into load bearing engagement with the lower edges of the recesses R1, R2 in the end bar. The flat load-bearing edge 313 of the tongue preferably has a length only slightly greater than the thickness of the side bar edge 241 bearing against the tongue so that side bar is restrained against as lateral movement when the two bars are in the assembled condition shown in FIG. 30. The two bars are further restrained against lateral movement relative to one another due to the relatively tight fit of the bridge portions 285, 287 in the lower ends of the recesses R1, R2.

As illustrated in FIGS. 29 and 30, when the tongue 291 is fully received in the slotted formation 271 in the side bar 215, upper lateral portions of the tongue project up through the slots 281, 283 in the side legs of the triangle of the side bar. These portions are adapted to be bent or wiped over by suitable forming elements 321 in a manual or automated operation so that they overlie respective side legs 237, 239 of the triangle of the side bar to hold the side bar and the end bar in assembly at the corner C. The detent 315 struck from the tongue 291 also functions to hold the bars 215, 217 together. It will be observed in this regard that as the tongue 291 of the end bar 217 moves up and though the slots in the side legs of the triangle of the side bar, the detent 315 moves up through the slot 273 and one of the notches 284 in the base 235 of the triangle, the notch providing the additional width necessary to accommodate the inclined detent (see FIG. 31). After the side bar 215 is fully seated on the end bar, the detent 315 is deformed laterally to the position shown in FIG. 32 in which it overlies the base 235 of the triangle to prevent separation of the two bars. Deformation of the detent to the position shown in FIG. 32 may be carried out using a suitable forming element 325 simultaneously with the bending of the tongue 291 to overlie the side bar. In any event, the bent tongue portions and detent hold the bars in assembly, yet still allow the bars to be readily disassembled. (Disassembly is accomplished by bending the tongue 291 and detent 315 bars to their original positions.)

Once the side bars 215 and end bars 217 have been assembled at the four corners C of the frame in the manner described above, a suitable number of cross arms 45 may be secured in place in the manner previously described, and a body support 3 attached to the frame, also as previously described. The end bars 217 are connected to the lift/tilt mechanism (not shown) of the coffin by suitable conventional clips (not shown) portions of which pass through holes 327 spaced at intervals along the end bars (see FIG. 24).

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A method of manufacturing a bed frame of rectangular shape for accepting a body support comprising: cold rolling a strip of sheet metal to form it into bar stock of such overall cross-section as to comprise a tubular section shaped to function as a beam with strength in bending resistant to forces transverse thereto, said cold rolling comprising superimposing a first marginal portion of the sheet metal strip flatwise against a second marginal portion of the strip to form a flange of double-layer construction extending inwardly from the beam; forming the bar stock into side bars and end bars of the rectangular frame; and forming the bed frame from said side bars and said end bars.

2. The method as set forth in claim 1 wherein said side and end bars are formed by notching said bar stock with notches at intervals such as to define said side bars and end bars, and segmenting the bar stock into lengths thereof with each length corresponding to the total length of the periphery of the frame and including a number of said notches defining corners of the frame to be formed.

3. The method as set forth in claim 2 wherein said bed frame is formed by bending said length of notched bar stock at said notches thereof to form it into said frame, bringing together the ends of said length, the notches where said length is bent forming mitered corners of the frame, and fastening said ends together.

4. The method as set forth in claim 1 further comprising securing said first and second marginal portions of the sheet metal strip to inhibit relative movement therebetween.

5. The method as set forth in claim 4 wherein said first and second marginal portions of the sheet metal are secured together by striking out tangs from said flange leaving openings therein, each tang being bent to extend through the respective opening away from one face of the flange and back on the other face of the flange.

6. The method as set forth in claim 4 wherein said first and second marginal portions of the sheet metal are secured together by fasteners.

7. The method of claim 1 wherein the strip is cold rolled to form it into the bar stock with said tubular section thereof in the shape of a hollow triangle in transverse section having an outside generally vertical leg and upper and lower legs converging from the edges of the outer leg toward one another and meeting at a point constituting an apex of the triangle, said first marginal portion of the strip extending generally horizontally inward from the inner edge of the upper leg at said apex and said second marginal portion of the strip extending generally horizontally inward from the inner edge of the lower leg at said apex forming said flange, wherein the bar stock is notched such as to form notches each of generally V-shape with the open end of the notch at the edge of the flange and the apex of the V in the tubular section, and wherein the bar stock is segmented at said notches spaced lengthwise thereof at such intervals as to form lengths of the stock each corresponding to the total length of the periphery of the frame with each length having a first portion extending from half of one of said notches at one end of said length to a first full one of said notches defining a first end bar of the frame, a second portion extending from the first full notch to a second full one of said notches defining a first side bar of the frame, a third portion extending from the second full notch to a third full one of said notches defining the second end bar, and a fourth portion extending from the third full notch to another half of one of said notches at the other end of said length defining the second side bar of the frame; bending said length at the said first, second and third full notches to form it into the rectangular frame with said full notches at first, second and third corners of the frame and bringing the ends of said length together at a fourth corner, and fastening said ends together at said fourth corner.

8. The method of claim 7 wherein integral portions of the flange are struck up at intervals along the length of the stock to form tabs for attachment to the frame of a body support.

9. The method of manufacturing a bed comprising: manufacturing a frame as set forth in claim 8, applying a bed support comprising a piece of plastic netting to said frame by stretching the netting and hooking it over said tabs, and bending down the tabs on the netting securely to fasten the netting to the frame.

10. The method of manufacturing a bed comprising: manufacturing a frame as set forth in claim 9 with the tabs on the end bars thereof, applying said bed support comprising a rectangular piece of plastic netting to said frame by stretching said piece of netting endwise and hooking it over said tabs on said end bars, and bending down the tabs on the netting to fasten the netting to the frame.

11. The method of claim 7 wherein said first and second marginal portions of the strip forming the flange are secured together at spaced intervals along the length thereof by striking out tangs from said flange leaving openings therein, each tang being bent to extend through the respective opening away from one face of the flange and back on the other face of the flange.

12. The method of claim 7 wherein the bar stock is notched with the apex of each of the V-shaped notches contiguous to the plane of the inside face of the vertical leg of said tubular section.

13. The method of claim 1 wherein the strip is cold rolled to form it into the bar stock with said tubular section thereof in the shape of a hollow triangle in transverse section having a lower generally horizontal leg and inside and outside legs converging from the edges of said lower leg toward one another and meeting at a point constituting an apex of the triangle, the first marginal portion of the strip extending generally vertically upward from the upper edge of one of said inside and outside legs at said apex and the second marginal portion extending generally vertically upward from the upper edge of the other of said inside and outside legs at said apex, wherein the bar stock is notched such as to form notches each having a first part in one of the side legs of the hollow triangle, a second part in the horizontal leg, and a third part in the other side leg, said parts being shaped for forming the frame with mitered corners, and wherein the bar stock is segmented at said notches spaced lengthwise thereof at such intervals as to form lengths of the stock each corresponding to the total length of the periphery of the frame with each length having a first portion extending from half of one of said notches at one end of said length to a first full one of said notches defining a first end bar of the frame, a second portion extending from the first full notch to a second full one of said notches defining a first side bar of the frame, a third portion extending from the second full notch to a third full one of said notches defining the second end bar, and a fourth portion extending from the third full notch to another half of one of said notches at the other end of said length defining the second side bar of the frame; bending said length at the said first, second and third full notches to form it into the rectangular frame with said full notches at first, second and third corners of the frame and bringing the ends of said length together at a fourth corner, and fastening said ends together at said fourth corner.

14. The method of claim 13 wherein the first part of at least one of said notches is triangular with an apex at the upper edge of said one side leg and with side edges diverging from said apex of said notch at right angles to one another to the lower edge of said one side leg, said side edges of said first part of the notch coming together on the bending step to form a mitered corner.

15. The method as set forth in claim 1 wherein said side and end bars are formed by cutting said bar stock into separate side and end bars, and then fastening the side bars and end bars together to form said bed frame.

16. The method as set forth in claim 15 further comprising securing said first and second marginal portions of the sheet metal strip together to inhibit relative movement therebetween.

17. The method as set forth in claim 16 wherein said first and second marginal portions of the sheet metal are secured together by striking out tangs from said flange leaving openings therein, each tang being bent to extend through the respective opening away from one face of the flange and back on the other face of the flange.

18. The method as set forth in claim 16 wherein said first and second marginal portions of the sheet metal are secured together by fasteners.

* * * * *